US005622015A

United States Patent [19]

Collins

[11] Patent Number: 5,622,015

[45] Date of Patent: Apr. 22, 1997

[54] METHOD AND APPARATUS FOR CONSOLIDATING EARTH AND ANCHOR SETTING DEVICE

[76] Inventor: James S. Collins, 320 Muskingham Dr., Marietta, Ohio 45750

[21] Appl. No.: 420,430

[22] Filed: Apr. 12, 1995

[51] Int. Cl.[6] ..... E02D 5/74

[52] U.S. Cl. ..... 52/160; 52/156; 52/162; 52/165; 405/231; 405/249; 405/271

[58] Field of Search ..... 52/155, 156, 160, 52/162, 164, 165, 166, 741.11, 749.1; 405/231, 232, 249, 271

[56] References Cited

U.S. PATENT DOCUMENTS

| | | | |
|---|---|---|---|
| 676,968 | 6/1901 | Stanton | 52/156 |
| 756,374 | 4/1904 | Justus . | |
| 787,017 | 4/1905 | Witmer . | |
| 817,044 | 4/1906 | Cissna . | |
| 899,274 | 9/1908 | Thomas . | |
| 948,532 | 2/1910 | Stocking . | |
| 963,791 | 7/1910 | Miller . | |
| 978,505 | 12/1910 | Stewart . | |
| 1,173,806 | 2/1916 | Johnson . | |
| 1,214,679 | 2/1917 | Hindmarsh . | |
| 1,217,128 | 2/1917 | White . | |
| 1,330,233 | 2/1920 | Blackburn . | |
| 1,569,857 | 1/1926 | Farb . | |
| 1,598,407 | 8/1926 | Tomkinson . | |
| 1,658,155 | 2/1928 | Blackburn . | |
| 1,807,488 | 5/1931 | Michalicek . | |
| 1,948,856 | 2/1934 | Heinrich . | |
| 1,973,995 | 9/1934 | Pieper | 52/160 |
| 1,994,520 | 3/1935 | Johns et al. . | |
| 2,176,566 | 10/1939 | Dillon | 52/160 |
| 2,362,556 | 11/1944 | Hubbard . | |
| 2,490,465 | 12/1949 | Ogburn . | |
| 2,678,540 | 5/1954 | Lorenz . | |
| 2,779,240 | 1/1957 | Gaydos . | |
| 2,942,426 | 6/1960 | Stoll . | |
| 2,955,430 | 10/1960 | Alston . | |
| 2,958,404 | 11/1960 | Smith . | |

(List continued on next page.)

FOREIGN PATENT DOCUMENTS

| | | |
|---|---|---|
| 217160 | 5/1957 | Australia . |
| 2519045 | 7/1983 | France . |
| 3835296A1 | 3/1989 | Germany . |

OTHER PUBLICATIONS

B. K. Hough, Basic Soils Engineering, Chapter 11, pp. 316–351.

Enterpac Catalog, 1991, pp. 1, 2, 5, 6, 13, 14, 51, 52, 69, 70, 103, 104, 111.

*Primary Examiner*—Carl D. Friedman
*Assistant Examiner*—Kevin D. Wilkens
*Attorney, Agent, or Firm*—Webb Ziesenheim Bruening

[57] ABSTRACT

An apparatus for consolidating earth and anchor setting device. The apparatus includes a vertical support, a plurality of spaced media consolidation plates swingably mounted to the vertical support, a rib disposed along a lower edge of respective ones of the consolidation plates and a bearing plate secured to the vertical support. The apparatus can be used to install a bearing and moment foundation having an upper surface, a lower surface and a converging side surface. The upper surface is adapted to receive a pushing force for pushing the foundation into the soil and the side surface adapted to contact the soil when a pushing force is applied to the upper surface. The anchoring device can also be used to install a pier foundation having a plug, an installation load bearing member, an installed load bearing member and a cap. A grillage assembly can be used to install the foundation and includes at least a pair of intermediate members forming a grillage, at least one anchor securing the grillage to the soil and a plate member secured to the grillage intermediate members and positioned above the soil surface to assist in at least one of installing a foundation, removing an anchor, testing the strength of an anchor and testing the strength of a foundation. Also disclosed are methods of installing an anchor and a foundation.

4 Claims, 17 Drawing Sheets

U.S. PATENT DOCUMENTS

| | | | |
|---|---|---|---|
| 2,982,103 | 5/1961 | Revesz et al. . | |
| 3,011,598 | 12/1961 | Galloway et al. . | |
| 3,056,477 | 10/1962 | Wooley . | |
| 3,066,769 | 12/1962 | Pasquale . | |
| 3,118,284 | 1/1964 | Cobi . | |
| 3,131,544 | 5/1964 | Thornley . | |
| 3,187,858 | 6/1965 | Champs . | |
| 3,206,373 | 9/1965 | Dupuy . | |
| 3,214,918 | 11/1965 | Binnings . | |
| 3,222,842 | 12/1965 | Luedloff et al. . | |
| 3,279,136 | 10/1966 | Smith . | |
| 3,342,444 | 9/1967 | Nelson . | |
| 3,432,977 | 3/1969 | Scholl . | |
| 3,512,319 | 5/1970 | Piacentino . | |
| 3,570,258 | 3/1971 | Fuller . | |
| 3,680,274 | 8/1972 | Deike . | |
| 3,763,610 | 10/1973 | Ballew . | |
| 3,797,260 | 3/1974 | Webb . | |
| 3,969,853 | 7/1976 | Deike . | |
| 4,015,433 | 4/1977 | Shibata . | |
| 4,023,314 | 5/1977 | Tanner . | |
| 4,083,191 | 4/1978 | Donnelly . | |
| 4,160,613 | 7/1979 | Stanwick . | |
| 4,189,879 | 2/1980 | Patterson . | |
| 4,225,269 | 9/1980 | Matsui . | |
| 4,252,472 | 2/1981 | Moraly . | |
| 4,351,136 | 9/1982 | Fuller | 52/155 |
| 4,530,190 | 7/1985 | Goodman . | |
| 4,547,106 | 10/1985 | Lipsker . | |
| 4,592,178 | 6/1986 | Lu . | |
| 4,593,500 | 6/1986 | Watson | 52/155 X |
| 4,603,520 | 8/1986 | Deike . | |
| 4,721,418 | 1/1988 | Queen . | |
| 4,843,785 | 7/1989 | Sero et al. . | |
| 4,882,891 | 11/1989 | Sero et al. . | |
| 4,974,997 | 12/1990 | Sero et al. . | |
| 5,108,068 | 4/1992 | Gingras | 52/160 X |
| 5,234,290 | 8/1993 | Collins . | |
| 5,255,480 | 10/1993 | Alsop . | |
| 5,460,231 | 10/1995 | Collins | 52/155 X |

METHOD AND APPARATUS FOR CONSOLIDATING EARTH AND ANCHOR SETTING DEVICE

BACKGROUND OF THE INVENTION

1) Field of the Invention

This invention relates to soil compacting methods, devices and systems and, more particularly, to methods, devices and systems for utilizing and/or increasing the load bearing capacity of soil.

2) Description of the Prior Art

Structural foundations are designed to transmit the weight of the structure to the underlying soil or rock, and serve as a basic supporting member. The foundation must be essentially unyielding, since one of the chief requirements is the minimization or elimination of settlement due to yielding of the soil under the applied loads.

Structural foundations are of two main types, namely, spread foundations and pilings. A spread foundation is a structural element designed to distribute a concentrated load to reduce the distributed pressure to an allowable level which can safely be supported by the soil thereunder.

When the soil at or below the level where the spread foundation would normally be placed is unsuitable, then the weight of the structure must be transferred to the soil at greater depths or to rock. Bearing piers or caissons are used for this purpose. Such piers can be friction piles, which are supported through skin friction in a manner well known in the art.

However, bearing pier foundations provide very little, if any, resistance to twisting loads applied to the foundation, since their primary purpose is to support vertical loads.

Therefore, it is an object of the present invention to provide a bearing pier type foundation that gives support for vertical loads, as well as the twisting loads.

Spread foundations are preferable because they are relatively inexpensive compared to piles. However, when the safe bearing capacity or bearing value of the soil is less than the pressure applied to the soil by the foundation, then the foundation must be made of piles, unless the soil can be stabilized. The most popular way to stabilize the soil is through compaction by vibrating devices or rollers.

Present methods of compacting loose grain soil can increase the load-bearing capacity of the soil substantially. However, under the present systems, compacting soil requires extensive amounts of machinery and considerable amount of time. Pile driving causes soil failure during installation with little to no compaction. Further, with pile foundations, the integrity of the pile can be compromised during installation due to the compressive forces applied to the pilings.

Therefore, it is an object of my invention to install pilings cheaper and more effectively than that in the prior art, while compacting the surrounding soils during the installation process.

SUMMARY OF THE INVENTION

My invention is a bearing and moment foundation for use in soil having an upper surface, a lower surface and a converging side surface. The upper surface is adapted to receive a pushing force for pushing the foundation into the soil. The side surface is adapted to contact the soil when a pushing force is applied to the upper surface. The converging side surface converges from the upper surface to the lower surface and defines at least one cutting edge. The cutting edge is a tip defined by the side surface.

The bearing and moment foundation can be installed with an anchoring and foundation apparatus adapted to be installed in an earthen hole having a vertical support, a plurality of spaced media consolidation plates swingably mounted about respective pivot points on the vertical support. Each of the plates has a media facing surface having an upper edge and a lower edge. The upper edge is positioned relatively closer to the vertical support than the lower edge. A rib is disposed along the lower edge of each of the consolidation plates. A bearing plate is secured to the vertical support and adapted to rest on a soil surface, whereby the bearing plate is forced into the soil and in turn compacts and consolidates the soil when the consolidation plates are forced outwardly into the soil to compact and consolidate the soil adjacent thereto.

The anchoring and foundation apparatus can be used to install a pier foundation having a plug, an installation load bearing member, an installed load bearing member and a cap. The plug extends along a first longitudinal axis and includes a first section and a second section. The first section is adapted to receive a pushing force and the second section is adapted to rest on the soil. The installation load bearing member extends along the first longitudinal axis and includes a first end and a second end. The first end of the installation load bearing member is received by the first section of the plug. The installed load bearing member extends along a second longitudinal axis and includes a first end and a second end. The first end of the installed load bearing member is received by the first section of the plug. The cap coacts with the second end of the load bearing member. The cap is adapted to receive a pushing force, whereby the pushing force applied to the cap causes a pushing force to be applied to the installation load bearing member, which causes a pushing force to be applied to the first section of the plug. The cap, plug, installed load bearing member and/or the installation load bearing member can be combined to form a kit. A waterproof sleeve, such as a plastic sleeve, can be secured to an outer surface of a wooden installed member. An extendable hydraulic setting tool and an anchor can be used to install the foundation.

My invention is also a method for installing the pier foundation in soil including the steps of placing the second end of the plug on the surface of the soil, applying a pushing force to the cap and forcing the plug and at least a portion of one of the load bearing members into the soil thereby compressing and consolidating the soil adjacent the plug.

My invention is also an apparatus for compacting and consolidating soil having a pivot plate, a plurality of spaced media consolidation plates swingably mounted about pivot points on the pivot plate, an arrangement for outwardly swinging the media consolidation plates about a pivot point and a bearing plate coupled to the pivot plate and adapted to rest on an upper surface of the soil when the consolidation plates are received within a bore hole of the soil. The media consolidation plates have a media facing surface. A threaded, vertical central rod can be coupled to said pivot plate and include a nut threadably received thereon adjacent to the pivot plate. A nut tightening apparatus can be received by the vertical central rod and includes a tubular member through which the vertical central rod passes. The tubular member includes a socket at one end that matingly engages the nut. A device for rotating the socket relative to the vertical rod is coupled to the tubular member.

My invention is also a bearing moment foundation that can be installed using the apparatus for compacting and consolidating soil and includes a hollow tube, a bearing plate and a wedge member. The bearing plate has a hole passing therethrough. The hollow tube is secured thereto and depends therefrom. The hollow tube is positioned coaxial with the bearing plate hole. The wedge member is secured to the bearing plate and the hollow tube. The wedge member converges toward a distal end of the hollow tube. The wedge member defines a soil cutting tip adjacent the distal end of the hollow tube and defines a base adjacent the bearing plate. A lip is defined between said bearing plate and the base of the wedge member.

An anchor removal member can be used in connection with installing the above foundation. The anchor removal member includes a first plate having a hole, a second plate having a hole and a hollow tube having a first end secured to the first plate and coaxial with the first plate hole and the second end secured to the second plate and coaxial with the second plate hole. A plurality of support fins are secured to the first plate and the second plate, whereby the anchor removal member is adapted to assist in the removal of an installed anchor through the hollow tube.

A grillage arrangement can be used to install the above-mentioned foundations in soil. The grillage arrangement includes at least a pair of intermediate support members that are positioned adjacent each other forming a grillage, at least one anchor securing the grillage to the soil, and a plate member secured to the pair of intermediate members and positioned above the soil surface to assist in, at least one of, installing a foundation, removing an anchor, testing the strength of an anchor and testing the strength of a foundation.

A method of installing a foundation in the soil using the grillage includes the following steps: forming a grillage, anchoring the grillage to the soil, placing a foundation within the grillage and resting the foundation on the soil, securing a load bearing member to the grillage positioned above the foundation, positioning a forcing member between the foundation and the load bearing member, activating the forcing member so as to cause compressive forces to be applied to both the foundation and the load bearing member and forcing the foundation into the soil.

Figure 29:
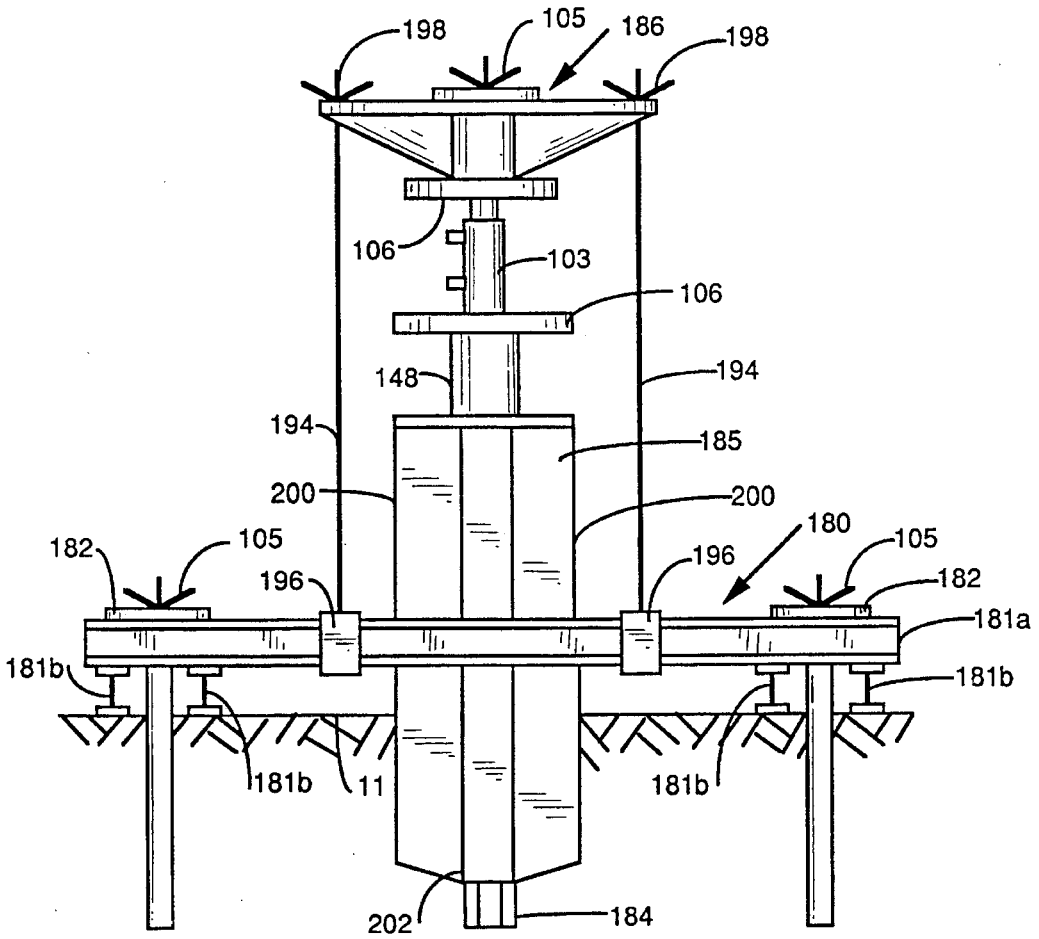
Figure 30:
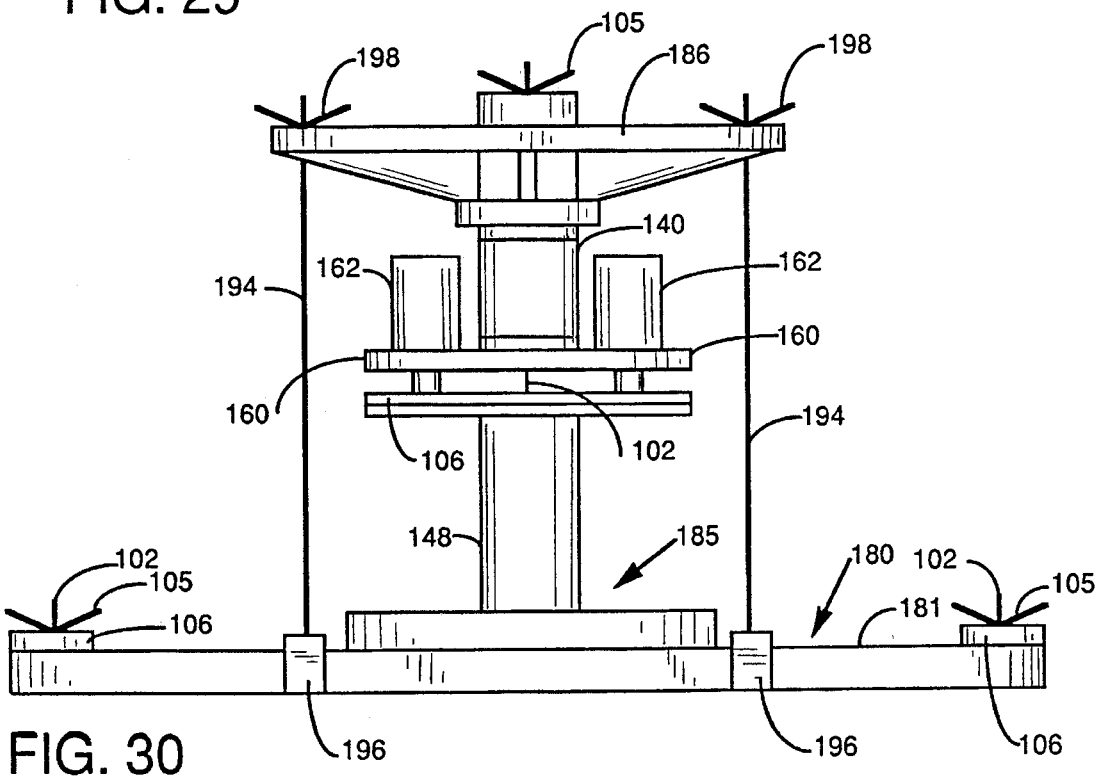
Figure 31:
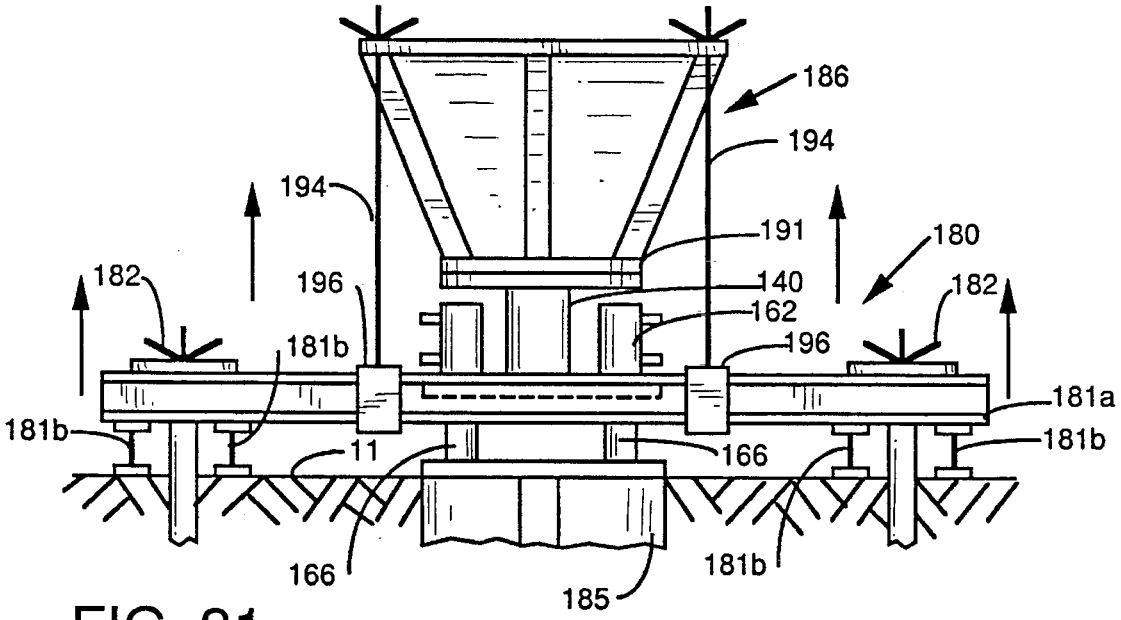
Figure 32:
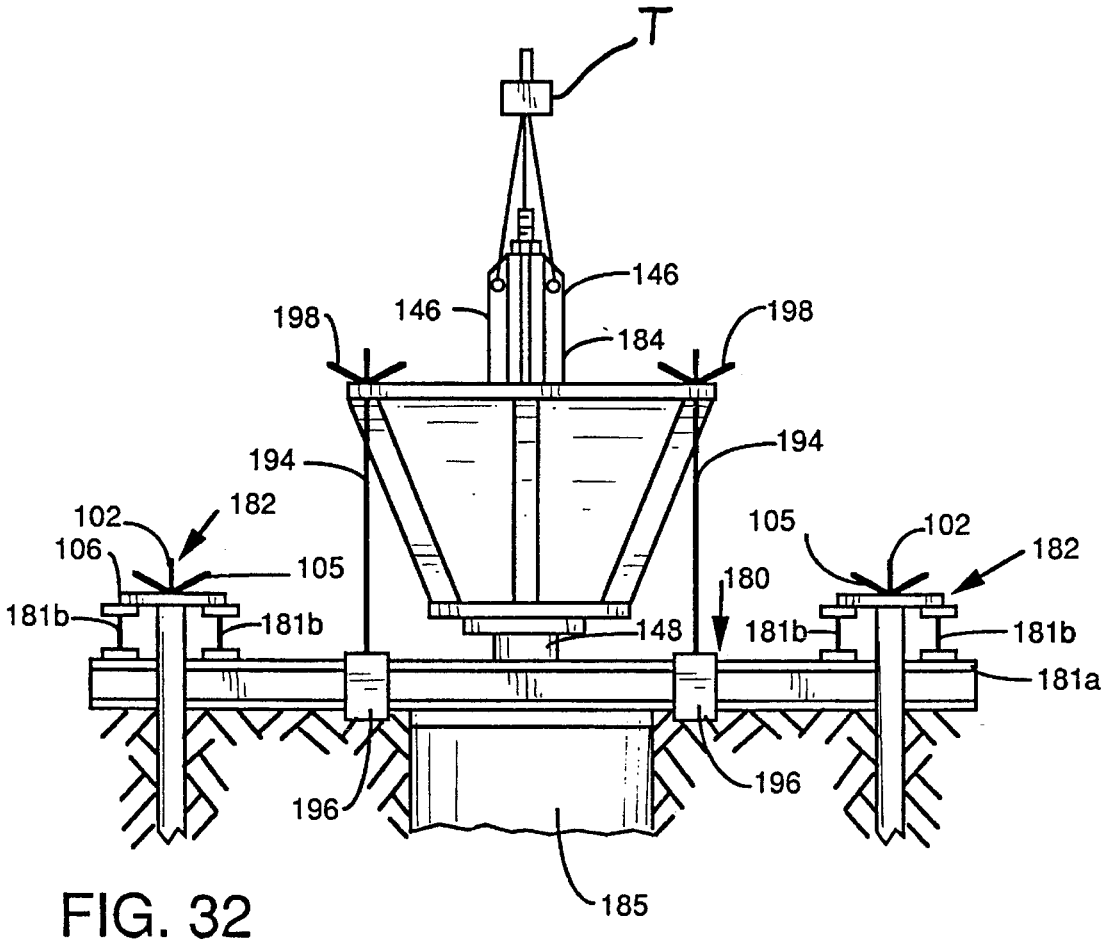
Figure 33:
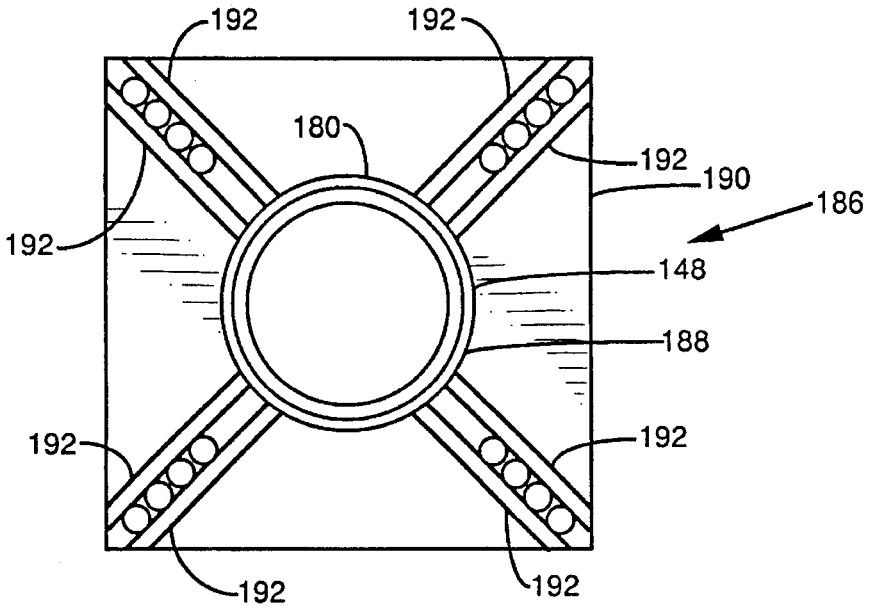
Figure 34:
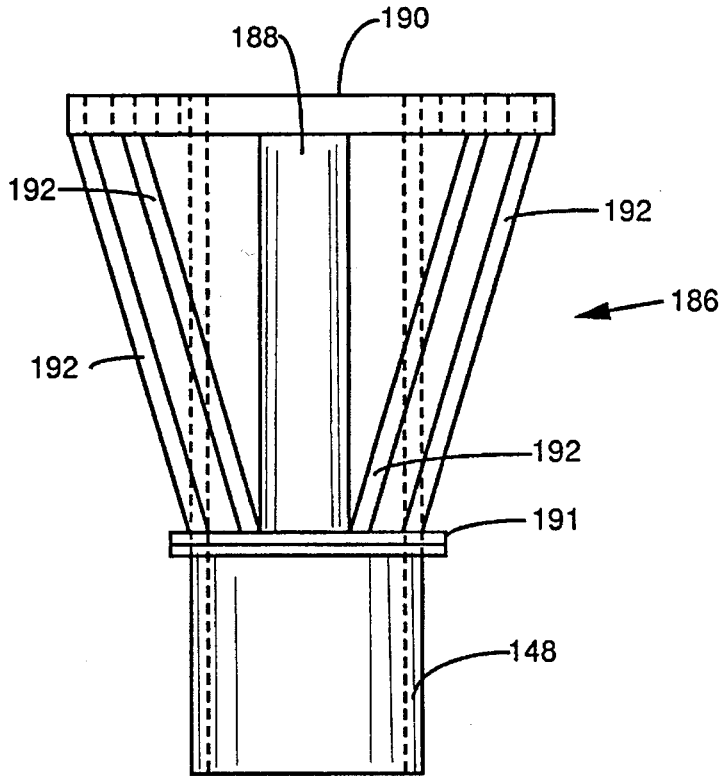

FIG. **28*a*** is a top view of a grillage made in accordance with the present invention;

FIG. **28*b*** is a top view of another embodiment of a grillage made in accordance with the present invention;

FIG. **28*c*** is a top view of another embodiment of a grillage made in accordance with the present invention;

FIG. 29 is a partial side view of the grillage shown in FIG. **28*b*** used in installing a foundation with an anchoring device made in accordance with the present invention;

FIG. 30 is a partial side view of the grillage shown in FIG. **28*c*** used to install a foundation with an anchoring device made in accordance with the present invention;

FIG. 31 is a partial side view of the grillage shown in FIG. **28*b*** showing a test arrangement for testing the strength of an installed foundation;

FIG. 32 is a partial side view of the grillage shown in FIG. **28*a***, wherein an anchoring device is being removed through an anchor removal member after a foundation has been installed;

FIG. 33 is a bottom view of the anchor removal member and centering member made in accordance with the present invention; and FIG. 34 is a side view of the anchor removal member and centering member shown in FIG. 33.

DESCRIPTION OF THE PREFERRED EMBODIMENTS

Figure 1:
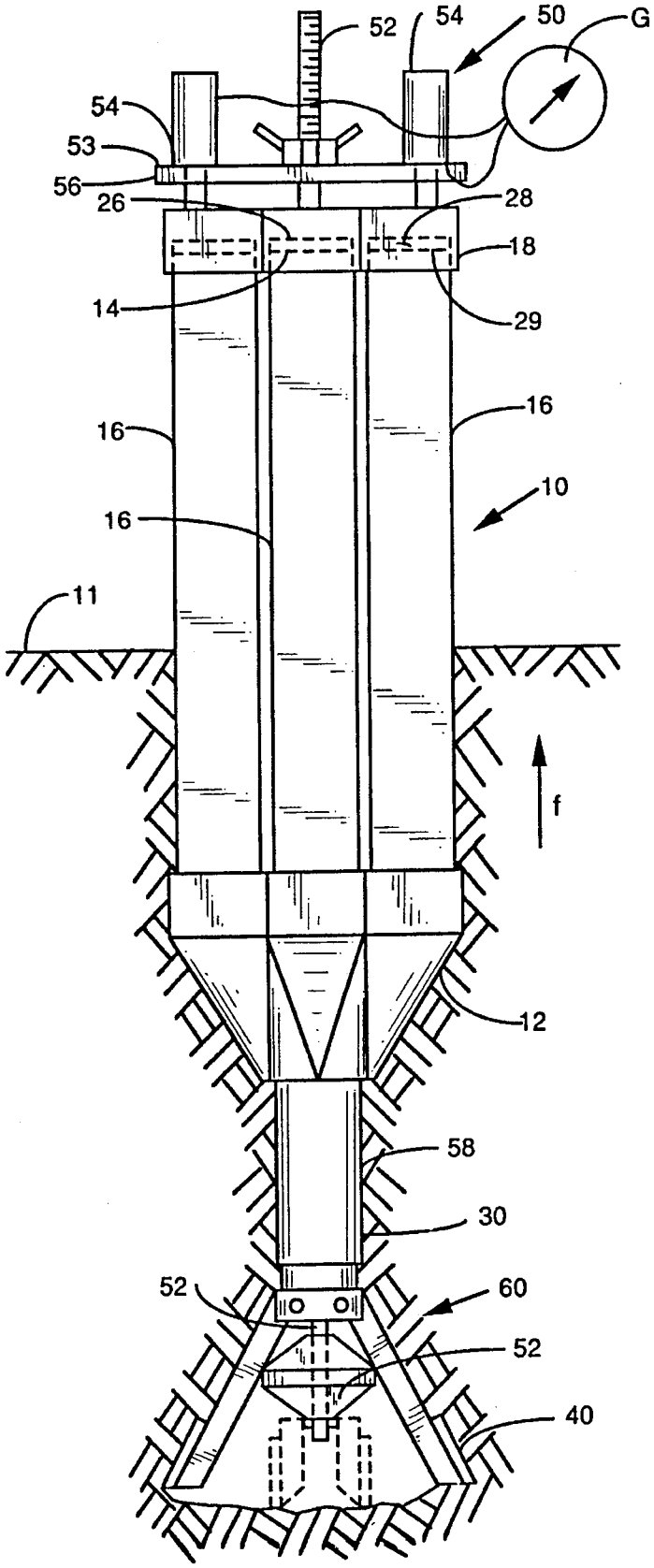
FIG. 1 is a partial sectional view of a pier foundation being set in soil made in accordance with the present invention.
Figure 2:
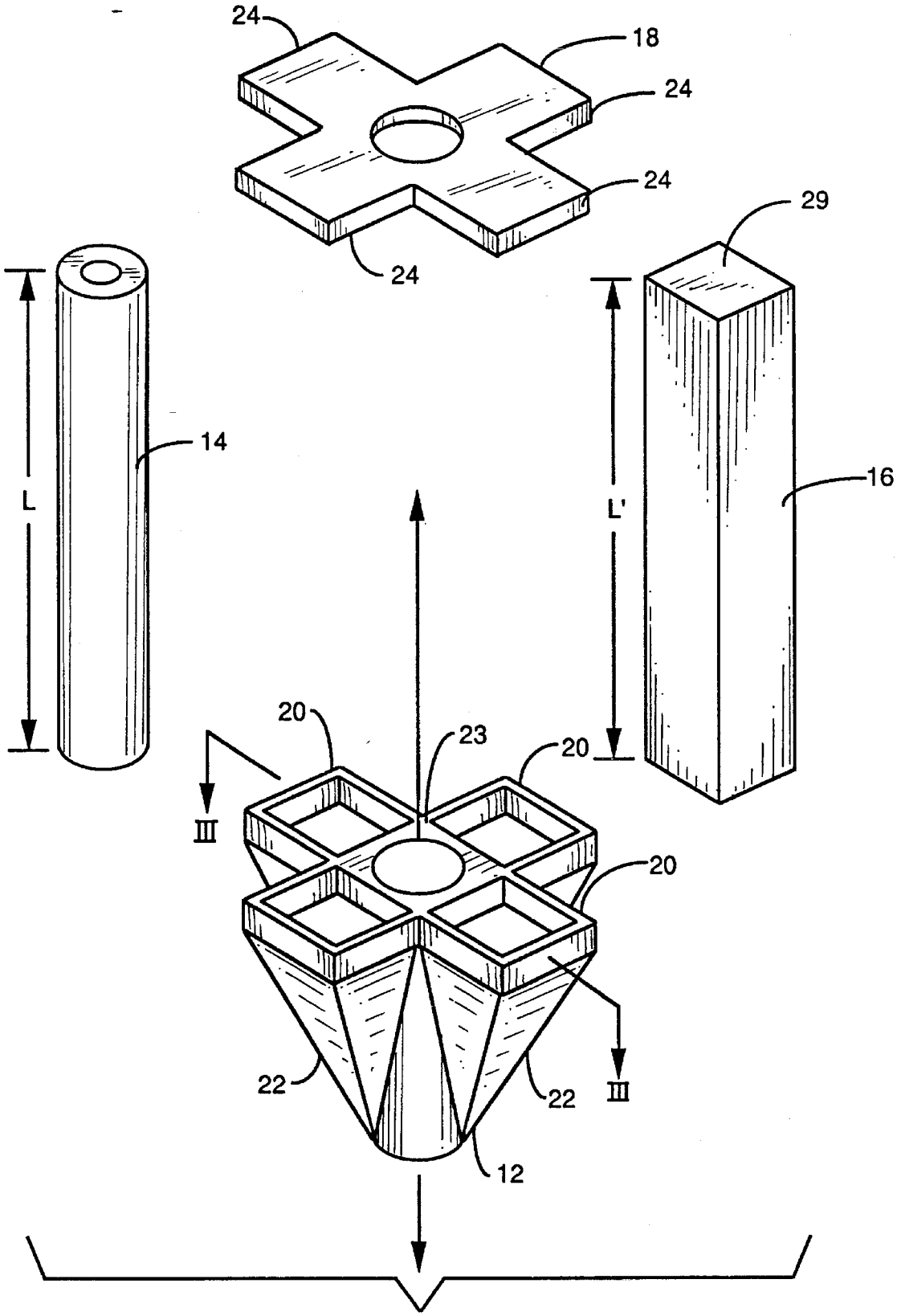
FIG. 2 is a fragmentary view of the pier foundation shown in FIG. 1.
Figure 3:
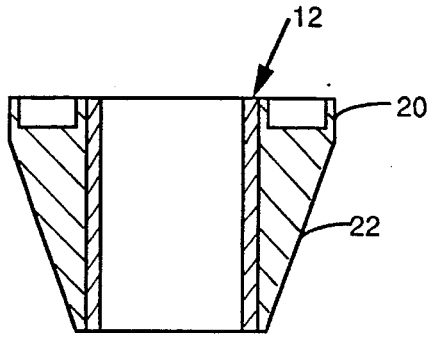
FIG. 3 is a section taken along lines III—III of FIG. 2.

FIGS. 1–3 of the drawings show a pier foundation 10 for use in soil, made in accordance with the present invention. FIG. 1 shows the pier foundation 10 being installed into soil 11. As shown in FIG. 2 of the drawings, the pier foundation includes a plug 12 extending along a vertical or longitudinal axis, a hollow cylindrical bearing member or installation load member 14, four wooden piers or installed load members 16 (of which only one is shown in FIG. 2), and a cap 18.

The plug 12, which is also shown in FIGS. 1–3 and 10, can be a unitary body made of concrete, plastic or metal, such as cast iron, and includes an upper section defining four recessed compartments 20 equally spaced around a central hole. A central tubular section or tube extends downwardly from the central hole and is coaxial therewith. Four soil engaging sections or legs 22 are provided on a lower section of the plug 12 with each lower section having an angled surface that converge toward a lower end of the tube from an adjacent compartment 20 forming a tip. The outer perimeter of the lower end of the tube is less than the outer perimeter of an upper end of the lower section. The upper end of the lower section of the plug 12 is adjacent the upper section of the plug 12. Soil engaging sections 22 have a triangular shaped cross-section.

The plug 12 is adapted to receive a lower end of the hollow cylinder 14 so that the lower end of the hollow cylinder 14 abuts against the plug 12 on a surface 23 to pass compressive forces thereto. The hollow cylinder 14 is coaxial with the plug central tubular section. The compartments 20 include a square recess that receives the wooden piers 16, which have a square cross-section. The recesses and piers 16 can also take any other shape. Preferably, the hollow cylinder member 14 has a longer length L than the length L' of the piers 16. Piers 16 extend along axes parallel to the X axis which also pass through respective soil engaging sections 22. Preferably, piers 16 are positioned adjacent sections 22.

Figure 6:
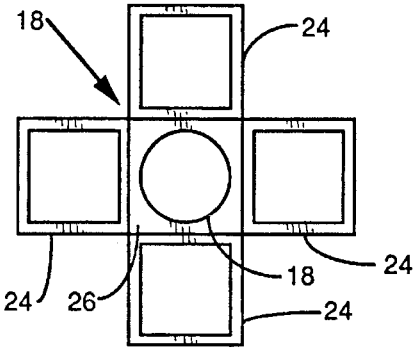
FIG. 6 is a top view of the cap shown in FIG. 1.

As shown in FIGS. 1, 2 and 6, the cap 18 looks similar to the upper section of the plug 12 and includes four recessed compartments equally spaced around a central hole. Upper ends of the wooden piers 16 are received within recesses defined by the compartments 24. An upper end of hollow cylindrical member 14 abuts against a lower surface 26 of the cap 18. Preferably, a gap 28 is present between the cap surface 26 and the upper ends 29 of wooden piers 16. Piers 16 can also be made of plastic, metal or concrete.

The following is a description of the installation of the pier foundation 10, which is similar to the installation of the plug disclosed in U.S. Pat. No. 5,234,290, which is hereby incorporated by reference. First, a bore hole 30 is dug in uncompacted soil. The bore hole preferably has the same or a slightly larger diameter than the inner diameter of the lower end of the plug tubular section. Initially, an anchor 40 is set in the soil by an anchoring device 50, such as that disclosed in U.S. Pat. No. 4,974,997, which is hereby incorporated by reference, or such as anchoring devices which are described hereinafter.

The anchoring device 50 includes a threaded rod or vertical support 52 and a hydraulic actuating arrangement 53 positioned directly above the plug 12, which includes two spaced apart hydraulic motor mean 54 each having a piston movable within a cylinder and a piston arm. Movement of the piston causes the piston arm to extend or retract. The motor means are secured to a bearing plate 56, so that the piston arms pass through spaced holes in the bearing plate 56. A retaining nut is threadedly received by the rod 52 and abuts against an upper surface of the bearing plate 56 to prevent upward vertical movement of the bearing plate 56. The hydraulic cylinders are fluidly coupled to hoses so that the cylinder can be charged with hydraulic fluid to cause the piston arms to extend outwardly from their respective cylinders. A change of hydraulic fluid pressure on the cylinder changes the distance between the upper surface of cap 18 and plate 56. The hoses are connected to a pressure gauge G and hydraulic fluid is contained within the hose and cylinders. A hole is provided in the plate 56 through which the threaded rod 52 passes. A tube or column 58 passes through hollow cylindrical member 14. A lower end of the threaded rod 52 attaches to an anchor pivot plate assembly 60 that includes side plates adapted to engage with a portion of the bore hole wall 30. Tube 58 is secured to the pivot plate assembly 60. Pivot plate assembly 60 and rod 52 form an anchor.

The anchoring device 50 is first installed in the soil without the pier foundation 10, so as to cause the side plates to engage the soil as shown in FIG. 1 and in a manner known in the art and described, for example in U.S. Pat. No. 4,974,997, which is hereby incorporated by reference. Alternatively, the anchor can be installed by an anchoring device described hereinafter. Also, any other anchor can be placed in the soil.

After the anchor is set, the hydraulic actuating arrangement 53 is removed and then the plug 12 is placed on the surface of the soil over the hole 30 and the tube 58 so that the plug central tubular section is coaxial with the bore hole 30. The tube 58 has a diameter less than the inner diameters of the plug tube and the hollow cylindrical member 14. Then the hollow cylindrical member 14 is placed over the tube 58 and received by the plug 12. Piers 16 are received by compartments 20 and the cap 18 is placed over the piers 16 and rests on the hollow cylindrical member 14. The hole defined in cap 18 is coaxial with the longitudinal axis. A threaded coupling and threaded rod may be required to extend the rod 52 above plate 56. The hydraulic actuating arrangement 53 is then reconnected to rod 52 so that the piston arms of the motor means 54 rest on the cap 18. The restraining nut is then replaced to abut against an upper surface of plate 56.

The hydraulic motor means 54 are then actuated by pressurizing the hydraulic fluid. This causes the piston arms to bear against or coact with the cap 18 and force the plug and at least a portion of hollow cylindrical member 14 and piers 16 into the soil. The hydraulic motor means 54 apply a pushing force to the cap 18. The majority of the compressive forces pass from the cap 18 to the plug 12 through the hollow cylinder 14 since the upper ends 30 of the wooden piers 16 are initially spaced from the bases of the compartments 24. However, some compressive forces are passed to the wooden piers 16 due to the soil friction forces f applied to the sides of the wooden piers 16 as the pier foundation 10 is forced into the soil. In that case, the wooden piers 16 may be slightly lifted from the plug 12 so that the upper ends 29 of the wooden piers 16 contact the cap 18.

The soil below the cap 18 and the plug 12 is then compacted and consolidated. The hydraulic motor means 54 is activated until a proper reading is obtained on the pressure gauge G to indicate the extent of compaction and consolidation of the soil around and below the foundation. Preferably, the reading is taken while the plug 12 is forced into the soil. When the wooden piers are set in a fixed depth in the soil, the hydraulic motor means may have to be deactivated so that the piston arms retract, the bearing plate lowered and the restraining nut lowered several times during the process. The piston can then be reactivated further pushing the plug into the soil. This is due to the limited length of the piston arm. Alternatively, the motor means 54 can be activated until the wooden piers are set to a fixed depth in the soil.

Figure 4:
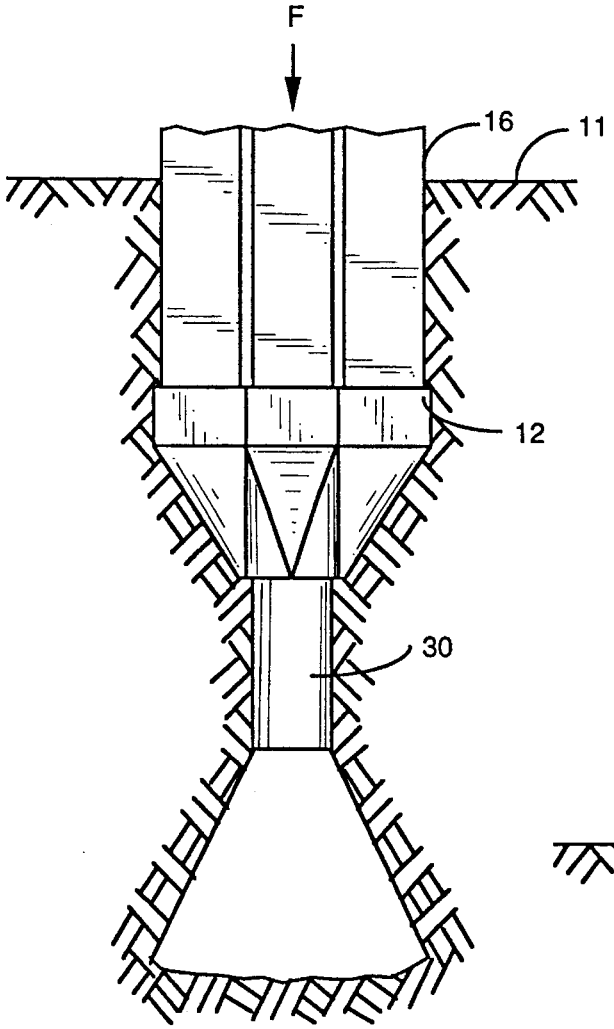
FIG. 4 is a partial side view of a portion of the installed foundation of FIG. 1.

Next, the bearing plate 56, the motor means 54, the cap 18 and the hollow cylindrical member 14 are removed. Also, the rod and the anchor pivot plate assembly can be removed by lowering the rod 52 so as to cause the plates to retract and be raised upwardly and removed. In some instances, it may be preferable to leave the anchor in place if a structure is to be attached to rod 52, requiring uplift prevention. A structure compressive force F can now be supported on the wooden piers 16, as shown in FIG. 4. Since the majority of the installation compressive force is taken up by the hollow cylindrical member 14, the wooden piers 16 have a greater integrity than had they taken the initially compressive forces due to installing the plug 12.

Figure 5:
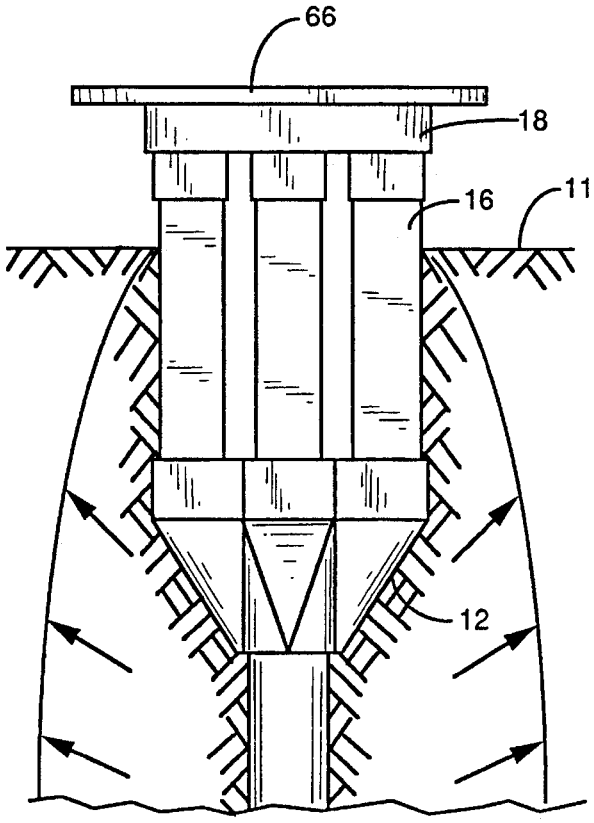
FIG. 5 is a side view of the installed foundation of FIG. 1 having a support plate attached thereto.

As shown in FIG. 5, the cap 18 can then be replaced onto the wooden piers 16 so as to rest on upper ends 29 of the wooden piers 16 or a bearing plate 66 can be secured to the upper ends 29 of the wooden piers 16 so that a structure can be supported thereon. Also, a central wooden pier (not shown) 16 can also be placed over the plug central hole and rest on the plug 12 to give added support in conjunction with the existing wooden piers 16.

Figure 8:
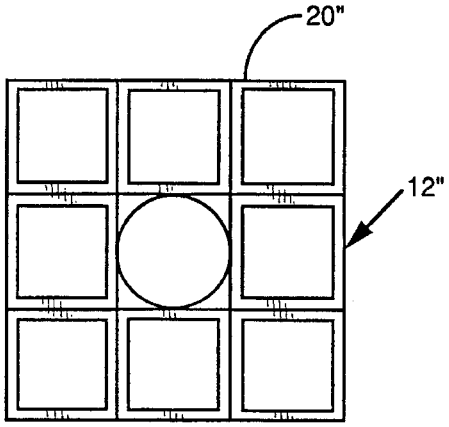
FIG. 8 is a top view of another embodiment of a plug for a pier foundation made in accordance with the present invention.
Figure 7:
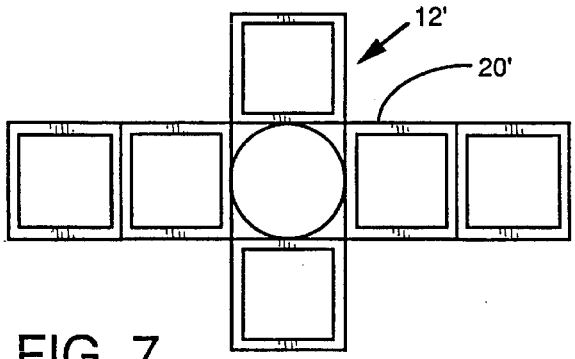
FIG. 7 is a top view of another embodiment of a plug for a pier foundation made in accordance with the present invention.
Figure 9:
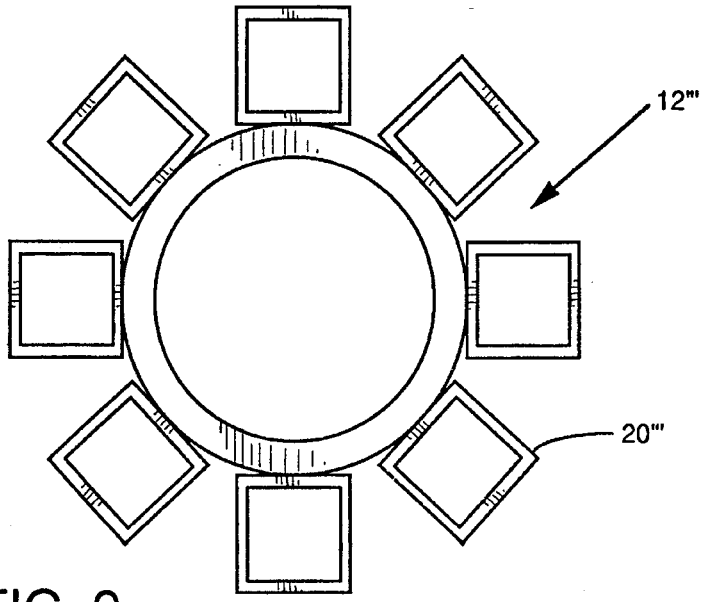
FIG. 9 is a top view of another embodiment of a plug for a pier foundation made in accordance with the present invention.
Figure 10:
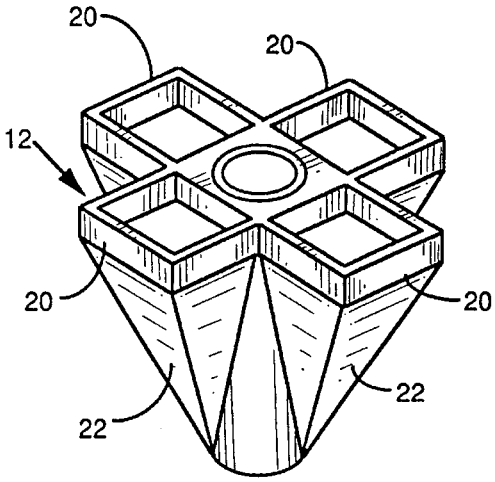
FIG. 10 is a top perspective view of the plug shown in FIG. 1.
Figure 11:
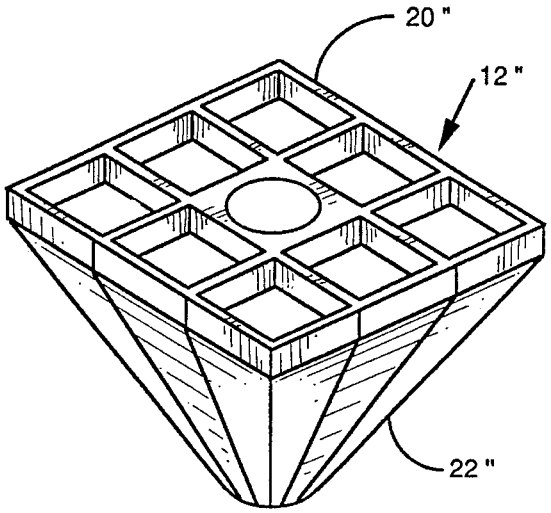
FIG. 11 is a top perspective view of the plug shown in FIG. 8.

Various orientation of caps and plugs can be provided to receive any number of piers. FIGS. 7–9 show several top views of various plug arrangements 12', 12", and 12''', having central holes and recessed compartments 20', 20" and 20''' to receive wooden piers 16. FIG. 11 shows a top perspective view of plug 12". Corresponding top caps are also required, although not shown.

Figure 12:
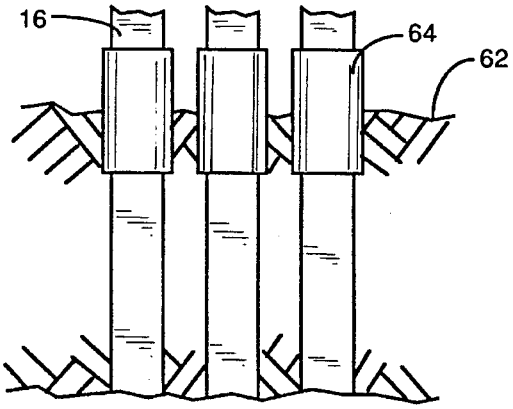
FIG. 12 is a partial sectional side view of a portion of a pier foundation having sleeves at the soil air interface.

A problem that wooden piers 16 exhibit is rotting near the air/soil interface 62 shown in FIG. 12. To overcome this problem, the piers 16 can be provided with plastic sleeves 64, as shown in FIG. 12. Also, other waterproof materials can be used for the sleeves 64 in lieu of plastic. Preferably, the sleeves are tightly received or bonded to the wooden piers 16 by an adhesive, such as epoxy or a waterproof adhesive so that moisture does not accumulate between the sleeve 64 and the wooden pier 16. Alternatively, a waterproof coating can be applied to the piers 16.

Figure 13:
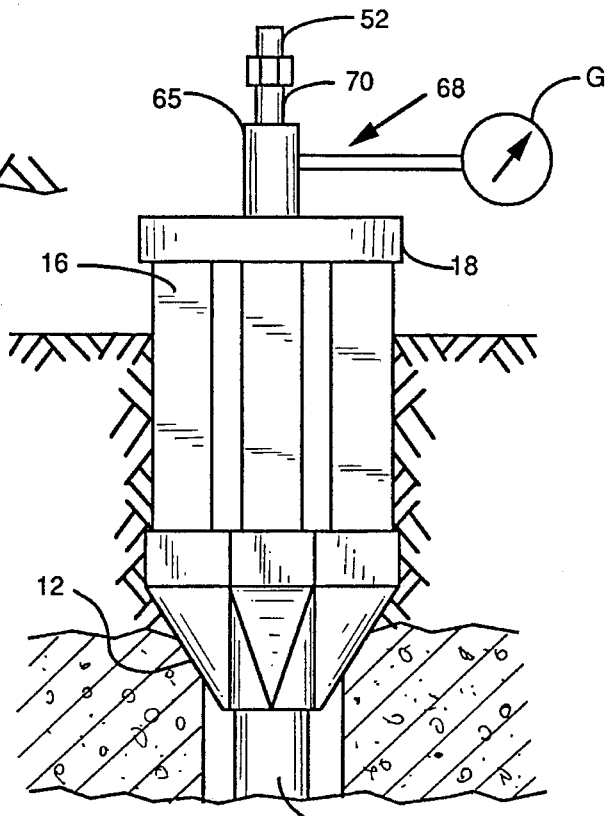
FIG. 13 is a partial side view of the pier foundation shown in FIG. 1 utilizing a different setting device.

FIG. 13 shows an alternate installation device where the motor means 54 is replaced with a hydraulically activated hollow core cylinder arrangement 68, such as the single-acting hollow plunger or piston and hydraulic cylinder manufactured and sold by Enerpac of Butler, Wis. under the trademark HOLL-O-CYLINDER®. Such hollow core cylinders are well known in the art and have annular holes defined in both the cylinder and the piston. Threaded rod 52 passes through the hollow core or annular holes defined in the piston 70 and of the cylinder arrangement 68. The restraining nut is received by rod 52 and rests on an upper surface of the piston 70 of the cylinder arrangement 68. A lower portion of the cylinder arrangement 68 rests on an upper surface of the cap 18. The cylinder arrangement 68 is connected to a hydraulic pump and pressure gauge via hoses. Supplying pressurized hydraulic fluid to the cylinder arrangement 68 causes the hollow plunger to extend upwardly and forces the pier foundation 10 downwardly. Individual elements of the plug 12, hollow cylinder 14, piers 16 and cap 18 can be sold as a kit.

Figure 14:
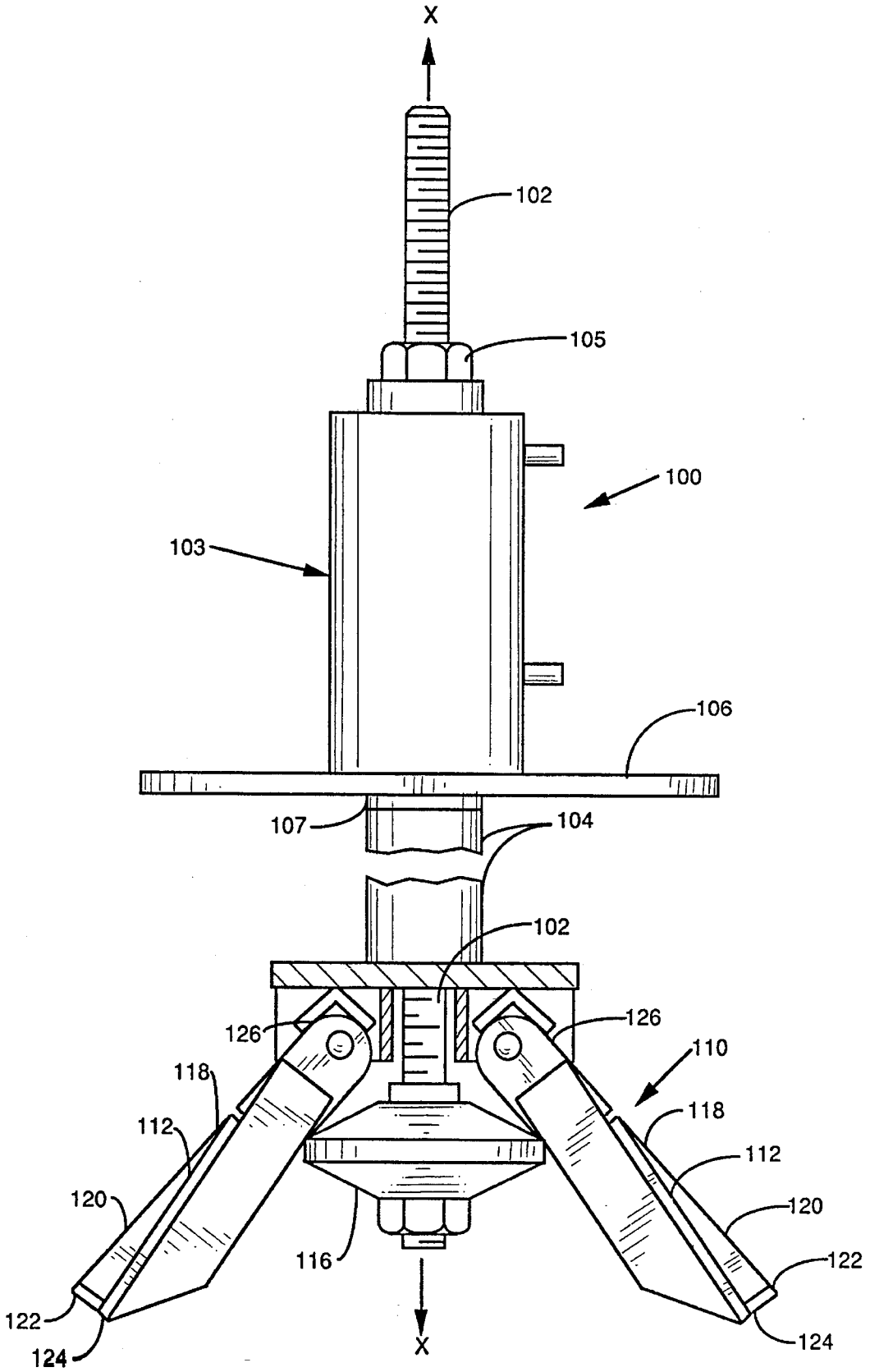
FIG. 14 is a partial sectional side view of an anchoring device made in accordance with the present invention.
Figure 15:
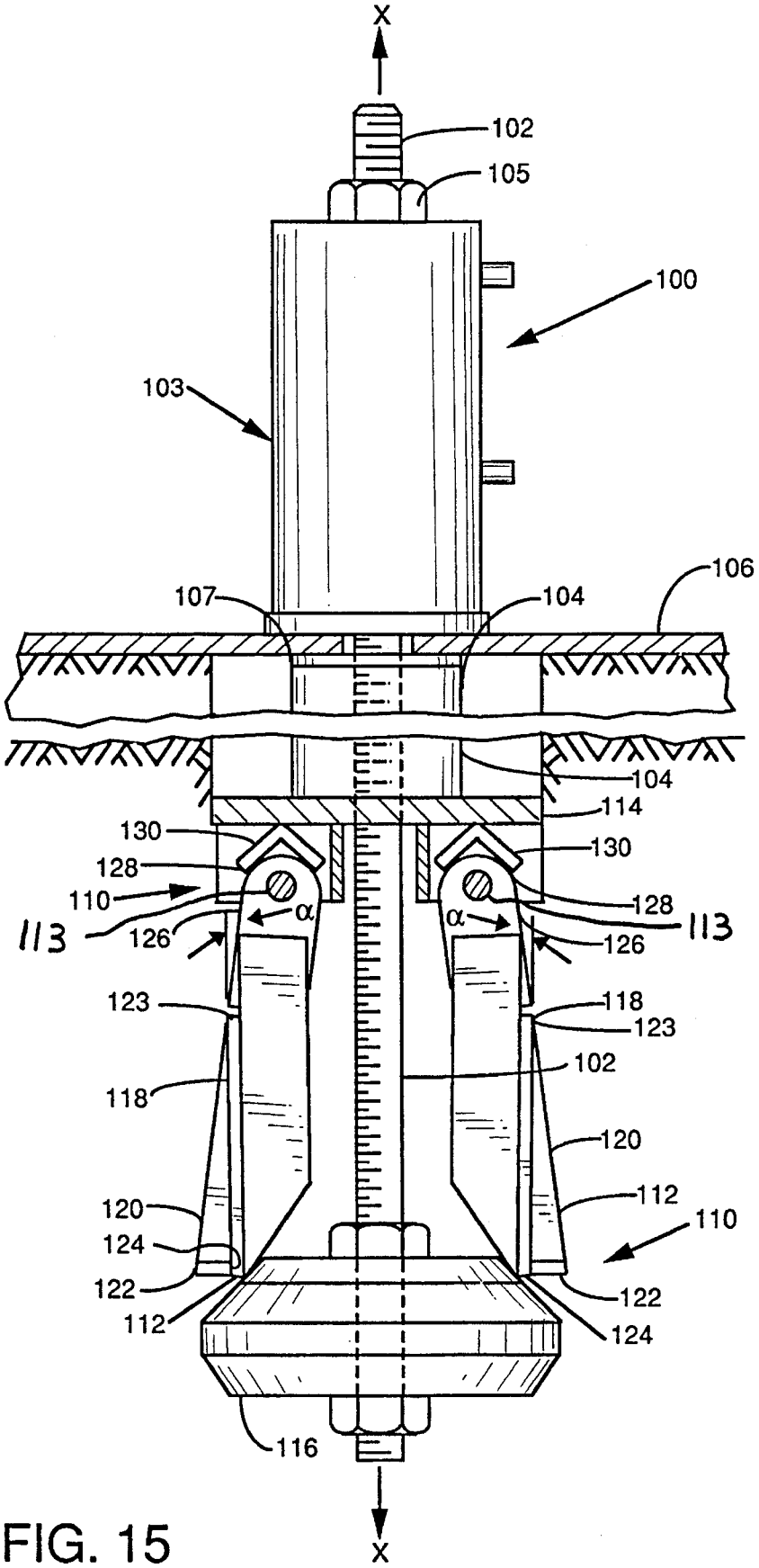
FIG. 15 is a partial sectional side view of the anchor setting device shown in FIG. 14 initially inserted in a bore hole.
Figure 16:
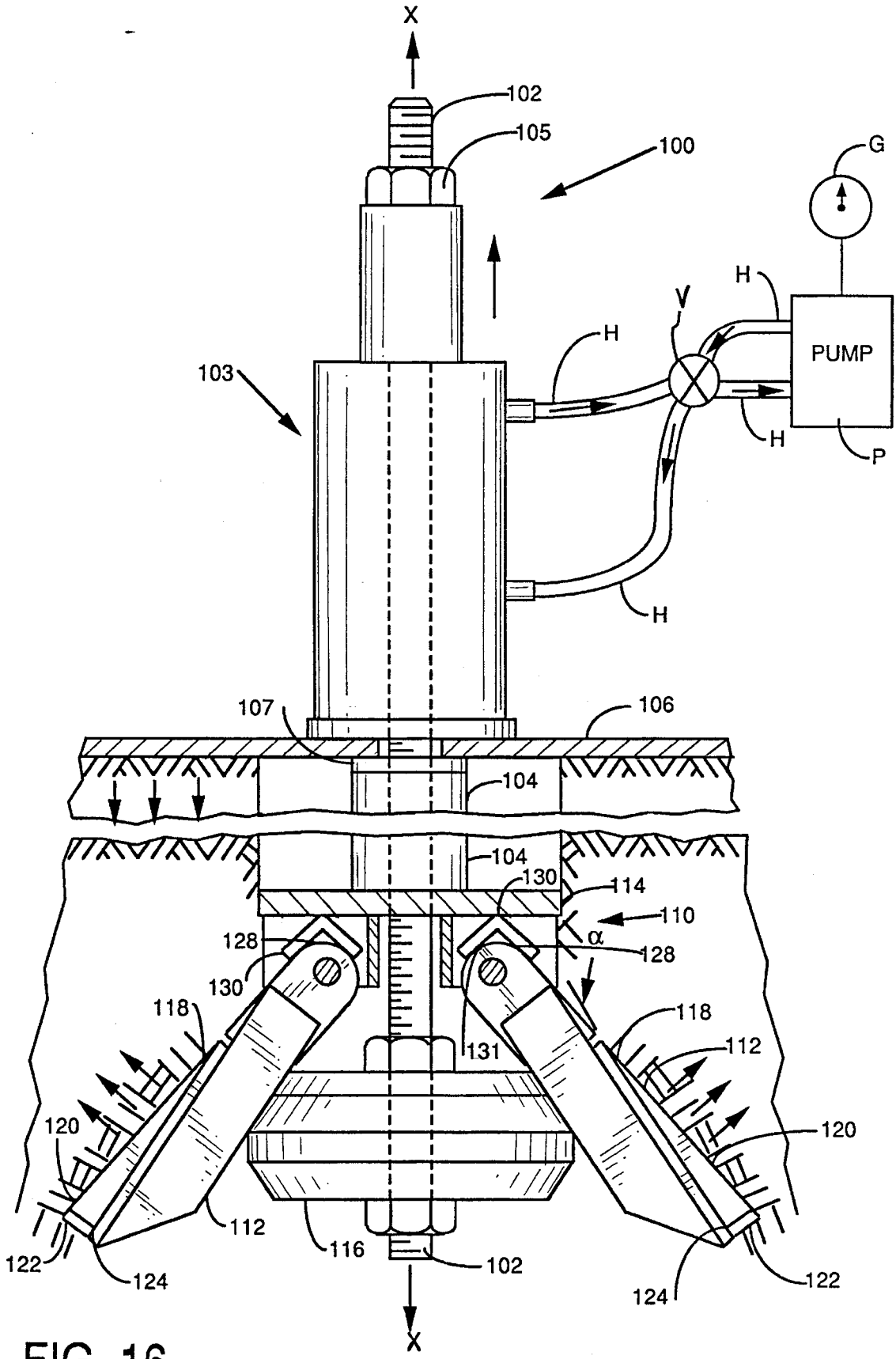
FIG. 16 is a partial sectional side view of the anchor setting device shown in FIG. 15 with soil consolidation side plates extended in the soil.
Figure 17:
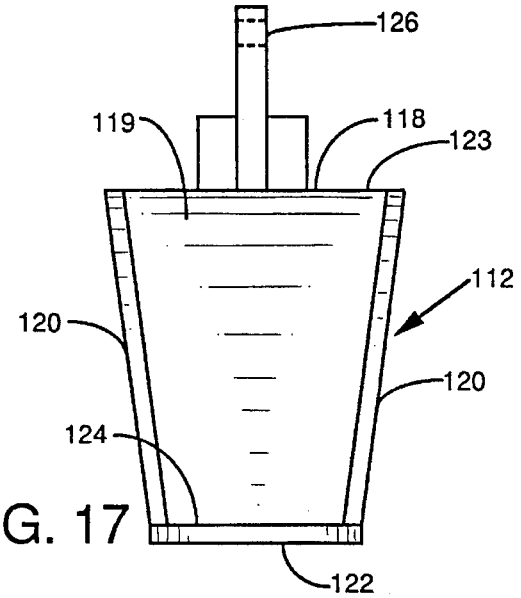
FIG. 17 is a top view of a soil consolidation side plate made in accordance with the present invention.

An alternative anchoring device 100 is shown in FIGS. 14–16 and can be used to set the pier foundation 10. Anchoring device 100 is similar to anchoring device 50, except for the below noted differences. Anchoring device 100 includes a threaded longitudinal rod or vertical support 102 that extends along the longitudinal axis X through a tube 104. A single-acting, hollow plunger cylinder 103, such as an Enerpac HOLL-O-CYLINDER® Single-Acting Hollow Plunger Hydraulic Cylinders manufactured by Enerpac, 13000 W. Silver Spring Drive, Butler, Wis. 53007, is coupled to an upper end of the rod 102. The single-acting, hollow plunger cylinder 103 includes a cylinder having an extendable hollow plunger or piston slideably received therein. When pressurized hydraulic fluid is supplied to the cylinder 103, the plunger extends in an upwardly direction along the longitudinal X axis. The upper end of the rod 102 passes through the plunger and a restraining nut 105 is threadably received by the rod 102 and rests on an upper surface of the plunger. A lower end of the cylinder 103 rests on a bearing plate 106. An upper end of tube 104 abuts a lower surface of the bearing plate 106. Tube 104 includes an annular plate 107 provided at an upper end thereof and through which rod 102 passes.

A lower end of the threaded rod 102 is coupled to an anchor pivot plate assembly 110 that includes bottom side plates or media consolidation plates 112 which are pivotally or swingably attached to a pivot plate or top cap 114 by pins 113 at pivot points. Preferably, four side plates 112 are provided spaced 90 degrees apart (only two plates are shown spaced 180 degrees apart). However, two side plates 112 spaced 180 degrees apart or any other number of equally spaced plates 112 will suffice. A lower end of tube 104 is secured to an upper surface of the pivot plate 114 and rod 102 passes through pivot plate 114. A pivot plate engagement member or cone 116 is attached to a lower end of the rod 102 by two nuts threadedly received thereon. Cone 116 includes an angled or tapered upper surface that is adapted to force the bottom side plates 112 outwardly when it and rod 102 are moved in the upwardly vertical direction relative to the pivot plate 114. Cone 116 also has a tapered lower surface.

Figure 18:
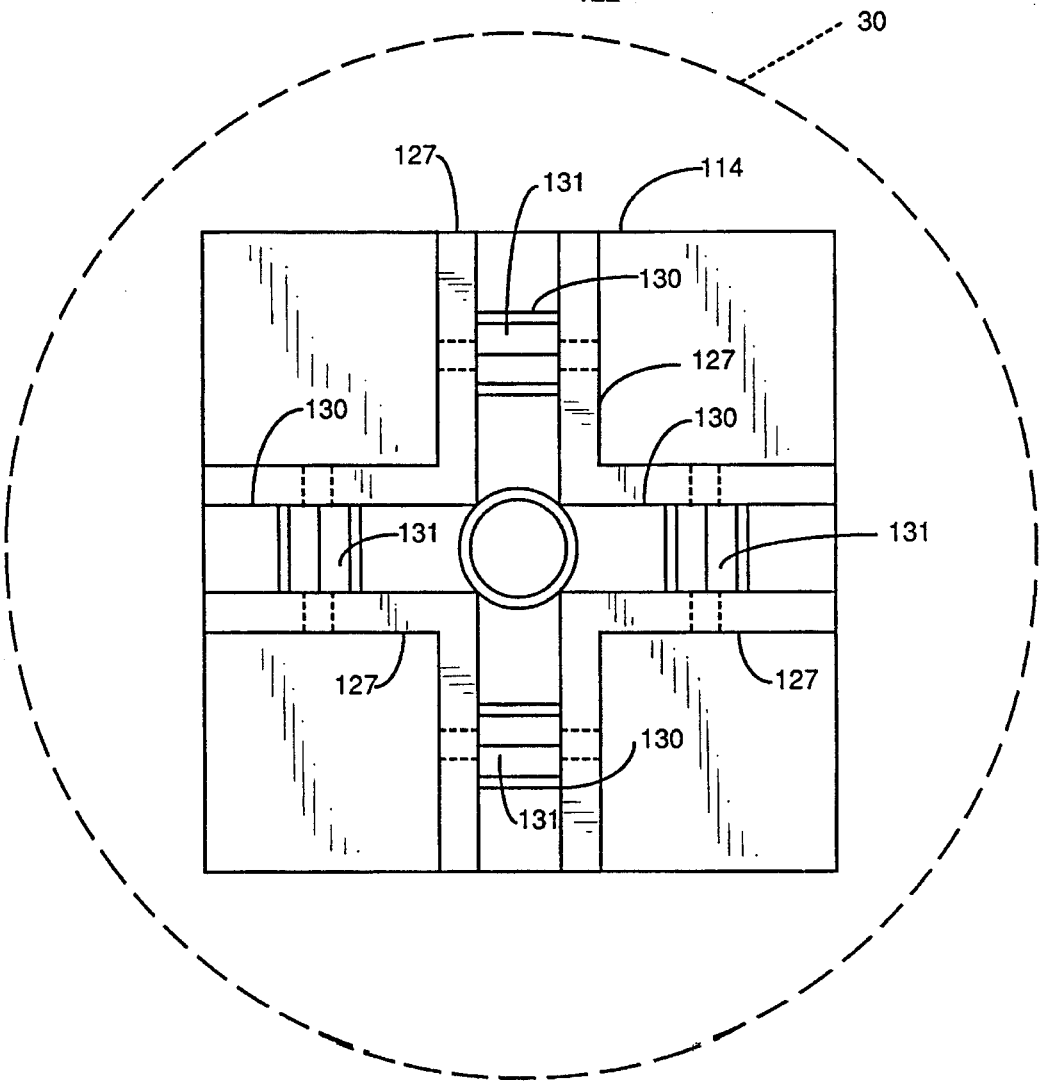
FIG. 18 is a bottom view of a pivot plate made in accordance with the present invention shown in FIG. 14.

As shown in FIGS. 14–17 of the drawings, each side plate 112 includes a substantially flat plate 118 having a soil engagement surface or media facing surface 119 with soil cutting bars or ribs 120 and 122 extending outwardly therefrom. Each of the soil engagement surfaces 119 includes an upper edge 123 and a lower edge 124, where the upper edge is positioned closer than the pivot plate 114 than the lower edge 124. It is believed that most preferably the cutting bar 122 be present while cutting bars 120 are optional. A cutting bar should not be positioned along the upper edge 123 of the soil engagement surface. Angled cutting bars 120 extend along opposite side edges of soil engagement surface 119 and bar 122 extends along the lower edge 124 of soil engagement surface 119, which is furthest from the pivot plate 114. Each plate 118 is attached to a lug 126 which is positioned at an angle $\alpha$ with respect to the soil engagement surface 119 of plate 118 so that oppositely positioned soil engagement surfaces 119 converge toward cone 116 when the outer edges of side bars 120 extend vertically and parallel to the longitudinal axis in an initial position prior to engagement with the soil. Preferably, angle $\alpha$ is such that the entire soil engagement surface 119 of each plate 118 initially contacts the bore hole walls during engagement, as opposed to only a portion of the soil engagement surfaces 119 initially contacting the wall, such as will happen if $\alpha$ is zero degrees. Lugs 126 are pivotally secured by pivot pins to downwardly extending support brackets 127 of pivot plate 114. As shown in FIG. 18, the outer edges of pivot plate 114 is less than the inner diameter of the bore hole 30. Also, when the plates 112 are in an initial nonengaged position, the side bars 120 and 122 will not contact the bore hole wall. Hence, the pivot plate assembly 110 can easily pass through the hole 30 and be guided by the outer edges of bars 120 and 122.

As shown in FIGS. 14–16, each upper end 128 of lug 126 is in the shape of a circular arc and is received by load bearing socket or support member 130. As shown in FIG. 18, each socket 130 has two legs preferably spaced 90 degrees apart, and can be made of angle iron. Each socket defines a sliding surface 131 which slideably contacts the upper end 128 of lug 126. The sockets 130 are secured to support brackets 127 of the pivot plate 114 and add support to the lugs 126 as the side plate 112 engages with the soil, thereby preventing undue stresses to the pivot pins 113 that secure the lugs 126 to the pivot plate 114.

Use of the anchoring device 100 will now be described. Initially, a bore hole 30 is formed, i.e., by boring, in uncompacted and unconsolidated soil 11. The cone 116 is secured to a lower end of rod 102 and the pivot plate assembly 110 and tube 104 are received by the rod 102. The tube 104, pivot plate assembly 110, cone 116 and the lower end of rod 102 are lowered into the bore hole 30. The bearing plate 106 is placed on an upper surface of the soil 11 so as to rest on an upper surface of the tube 104. The hollow plunger cylinder 103 is placed over an upper end of the rod 102 and is secured to the plate 106 by the restraining nut 105, which is threadably received by the upper end of the rod 102 and as shown in FIG. 15 of the drawings. Cylinder 103 is then fluidly coupled to a pump P and gauge G. Pressurized hydraulic fluid is supplied to the cylinder 103 through a hose H by the pump P causing the plunger to move upwardly. A valve V is provided to direct the flow of hydraulic fluid from the pump P to the cylinder 103 in a manner well known in the art. Bearing plate 106 is urged downwardly and cone 116 is urged upwardly by rod 102 causing side plates 112 to pivot upwardly and outwardly toward bearing plate 106. Once bars 122 engage the bore hole surface, the soil positioned adjacent to and between the bearing plate 106 and the soil engaging surfaces 119 is consolidated and compacted. This continues until the anchoring device 100 is set in the soil and/or the desired amount of compaction and consolidation is achieved, as shown in FIG. 16.

This can be determined through a pressure gauge reading from the pressure gauge fluidly coupled to the pump and the cylinder 103. The anchoring device 100 can then be removed and a structure placed on the compacted and consolidated soil. Alternatively, the anchor can be left in the soil and a structure attached to rod 102 where bearing and uplift prevention is required. The zones of influence defined between bearing plate 106 and plate 118 is greater than if the plate 106 were absent during the installation of anchor 100. Further, it is believed that by using the bearing plate 106 in combination with plates 118 only one rib, rib 122, is required on the plates 118, as opposed to two ribs, such as disclosed in U.S. Pat. Nos. 4,882,891 or 4,843,785, which are hereby incorporated by reference.

Figure 19:
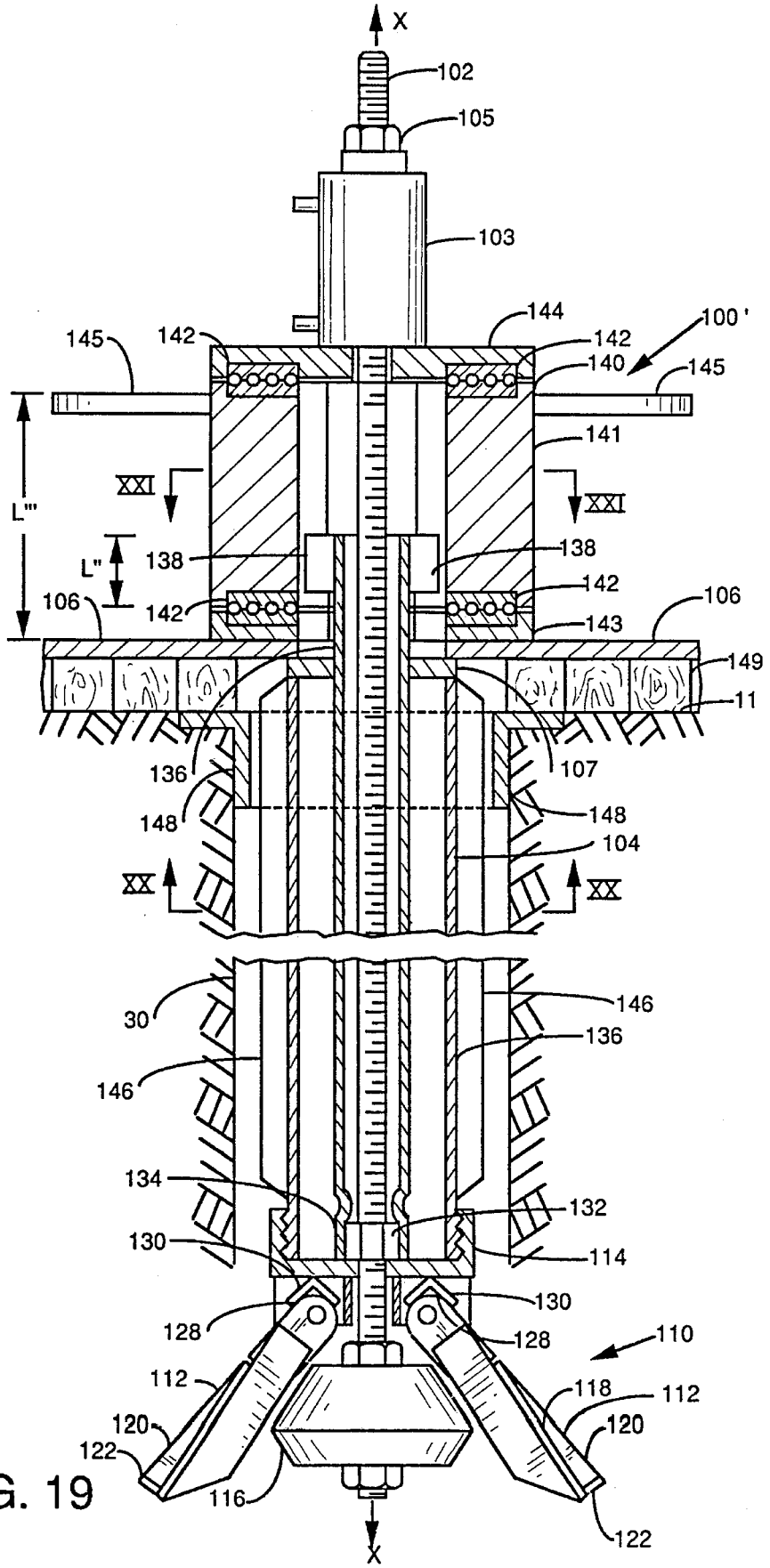
FIG. 19 is a partial sectional side view of another embodiment of an anchoring device and includes a nut tightening apparatus.
Figure 20:
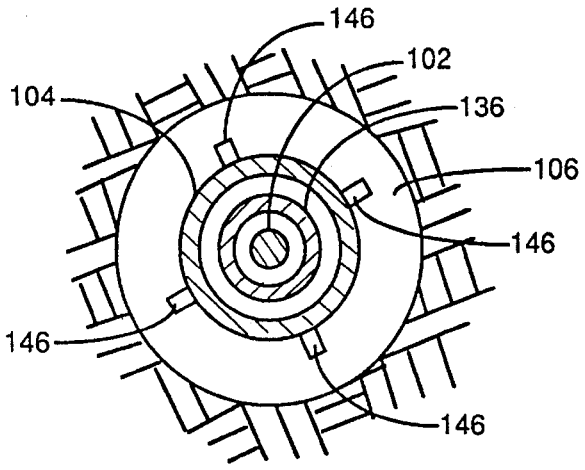
FIG. 20 is a section taken along XX—XX in FIG. 19.
Figure 21:
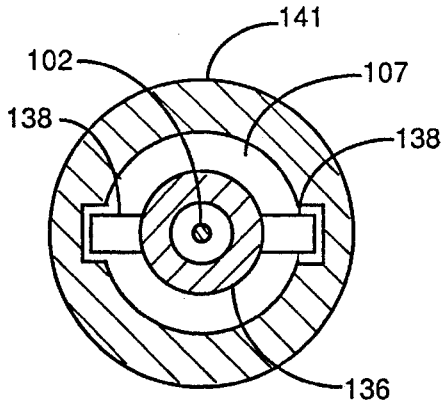
FIG. 21 is a section taken along XXI—XXI of FIG. 19.

FIGS. 19–21 of the drawings, show another embodiment of an anchoring device 100' made in accordance with the present invention. Anchoring device 100' is similar to anchoring device 100, except for the following differences. Like numerals are used for like elements. A nut 132 is threadably received by the rod 102 positioned above the pivot plate assembly 110. Tightening of the nut 132 locks the side plates 112 in place as will be discussed hereinafter.

A nut socket 134 matingly engages the nut 132. A tubular sleeve 136 is secured to nut socket 134. Rod 102 passes through nut socket 134 and sleeve 136. An upper end of the sleeve 136 includes a plurality of radially extending fins or drive members 138 received by slots defined in a nut tightening apparatus 140.

The nut tightening apparatus 140 includes a central cylindrical member 141 having a central bore with elongated slots defined therein. Rod 102 passes through the central bore. Thrust bearings 142 are provided on upper and lower ends of the cylindrical member 141. End plates 143 and 144 are secured to thrust bearings 142. Coaxial holes are provided in the end plates 143 and 144 to permit rod 102 to pass therethrough. The hole in plate 143 has a diameter sufficient to permit fins 138 to pass therethrough. The hole in plate 144 has a diameter sufficient to permit rod 102 to pass therethrough. Hence, the hole diameter in plate 143 is larger than the hole diameter in plate 144. Tubular sleeve 136 passes through plate 143. The slots defined in cylindrical member 141 permit fins 138 to move vertically along the X axis relative to the cylindrical member 141. The slots prevent fins 138 to rotate about the longitudinal X axis relative to the cylindrical member 141. When the cylindrical member 141 of the nut tightening apparatus 140 is rotated in a clockwise direction, the nut 132 travels down rod 102 and abuts against an upper surface of the pivot plate 114 thereby preventing the movement of the rod 102 in the downwardly vertical direction along the longitudinal X axis and thereby locking the side plates 112 in place and as shown in FIG. 19 of the drawings. Thrust bearings 142 permit the cylindrical member 141 to be rotated even when the nut tightening apparatus is under compression by cylinder 103 and bearing plate 106 as the side plates 112 are being engaged into the soil. When the cylindrical member 141 of the nut tightening apparatus 140 is rotated in a counterclockwise direction, nut 132 will loosen and travel upwardly toward bearing plate 106 and permit disengagement of the side plates 112 from the soil.

Removable handles 145 are provided on cylindrical member 141 to permit a person to rotate the central cylindrical member 141 relative to the end plates 143 and 144. Preferably, handles 145 are rods threadably received by threaded bores in the central cylindrical member 141. Preferably, the length of L" fins 138 should be substantially less than the length L'" of longitudinal slot in cylindrical member 141 so that there can be substantial freedom of movement in the longitudinal direction of the tube 130 during tightening and loosening of the nut 132. It is preferable that the fins 138 be positioned adjacent end plate 144 during tightening nut 132 and adjacent plate 143 during loosening nut 132.

In operation, the anchoring device 100' is inserted into a bore hole in the same manner as anchoring device 100. The socket 134 and sleeve 136 are received on rod 102 and engage nut 132. Nut 132 is sufficiently positioned on rod 102 so as not to contact pivot plate 114 when the side plates 112 are engaged in the soil. Nut tightening apparatus 140 is then placed on bearing plate 106 and the cylinder 103 is placed on the plate 144 of nut tightening apparatus 140. The nut 132 is tightened after the bottom side plates 112 are engaged in the bore hole wall. Then, cylinder 103, bearing plate 106, socket 134, the sleeve 136 and nut tightening apparatus 140 are removed and a structure and/or foundation can be secured to rod 102 and be anchored in place.

FIG. 19 of the drawings also shows that strengthening and guiding fins 146 can be secured to tube 104. Fins 146 add rigidity to tube 104 and assist guiding tube 104 in the bore hole 30. Also, a lower end of tube 104 can be threaded to pivot plate 114. A centering collar 148 can also be provided through which the tube 104 passes. Collar 148 includes a central tube that is received at an upper end of bore hole 30 and an annular flange attached to the central tube. The flange rests on an upper surface of the soil 11 adjacent bore hole 30. Wooden beams 149 can be provided and are sandwiched between plate 106 and the soil 11.

Figure 22:
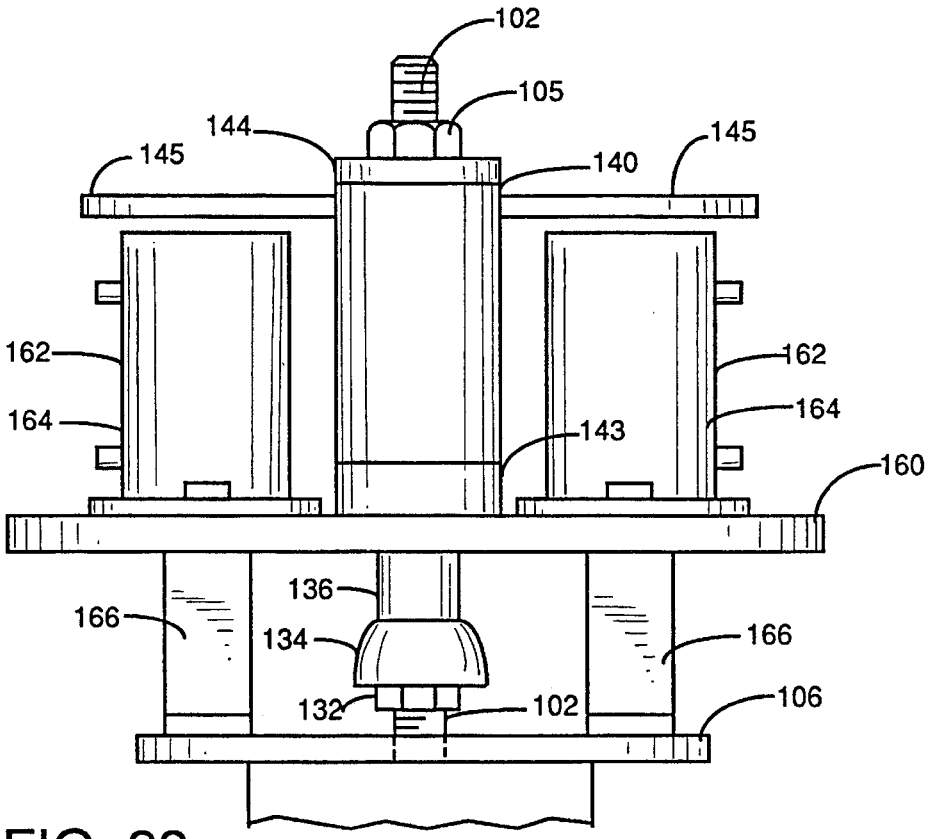
FIG. 22 is a partial side view of a portion of another embodiment of an anchoring device.

Alternatively, as shown in FIG. 22, nut 132 can be positioned on the rod 102 above the bearing plate 106. In this case, the bearing plate has a hole sufficient to permit rod 102 to pass therethrough, but small enough to permit nut 132 to abut against an upper surface thereof.

In the arrangement shown in FIG. 22 of the drawings, a support plate 160 is provided. Two spaced apart hydraulic cylinder arrangements 162 are provided. Each arrangement 162 includes a cylinder 164 having extendable pistons 166. One such hydraulic cylinder arrangement is a double-acting solid plunger hydraulic cylinder manufactured and sold by Enerpac. Pressurized hydraulic fluid causes the pistons to extend outwardly. The cylinders 164 are attached to the support plate 160 and the respective pistons pass through holes defined in the support plate 160. The nut socket 134 and sleeve 136 are similar to that shown in FIG. 19, except the sleeve 136 is shorter than that shown in FIG. 19. The nut tightening apparatus 140 is positioned over a hole defined in the support plate 160 through which the upper portion of sleeve 136 and rod 102 pass. A restraining nut 105 is secured on an upper end of the rod 102 and abuts against an upper surface of plate 144.

Supplying pressurized hydraulic fluid to the cylinders 164 causes the respective pistons 166 to push against bearing plate 106. This causes plate 144 to bear against restraining nut 105 thereby causing the plates 112 to engage in the soil and/or cause bearing plate 106 to be pushed into the soil. Once the plates 112 are engaged, then the nut 132 can then be tightened to bear against bearing plate 106 by the nut tightening apparatus 140 as previously discussed. Also, the nut 132 can be loosened by the apparatus 140. The nut tightening apparatus 140 and the nut socket 134 and sleeve 136 can be removed along with the respective hydraulic motor means after the nut 132 is tightened. Likewise, the nut socket 134, sleeve 136 and nut tightening apparatus 140 can be received by rod 102 to loosen the nut 132 at a later point in time.

Another alternative embodiment of the nut tightening apparatus 140 (not shown), includes modifying socket 134 so that it extends the entire length of the tubular sleeve 136 or extends a sufficient length to permit the nut 132 to travel a distance in the longitudinal X direction within the socket 134. In the latter case, the sleeve is substantially shortened. An end of the shortened socket or sleeve can have fins 138 received in the slots of cylindrical member 141 in the same manner as previously discussed or the upper end of the socket or the tubular sleeve can be fixedly secured to the cylindrical member 141. The thrust bearings and end plates of nut tightening apparatus 140 remain the same. During the nut locking process, the nut moves within the socket along the longitudinal X axis during engagement of the plates 112. The socket then is rotated thereby tightening the nut 132 against the pivot plate 114. The process is reversed to loosen the nut 132.

Figure 23:
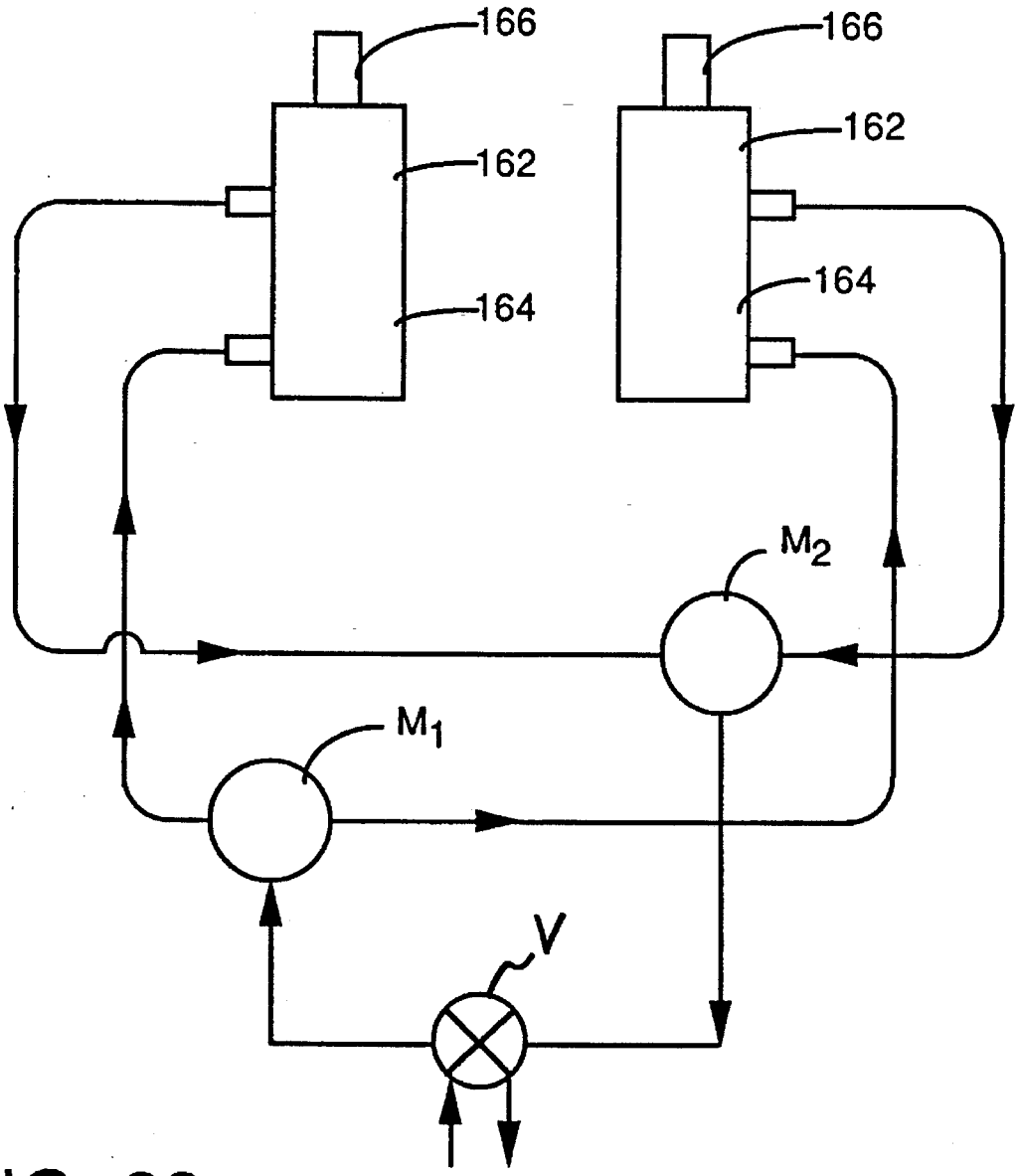
FIG. 23 is a schematic view of a hydraulic circuit of the hydraulic cylinder arrangement shown in FIG. 22.

FIG. 23 shows a schematic drawing of the hydraulic circuit supplying pressurized hydraulic fluid to cylinders 164. Pistons 166 extend away from cylinders 164 when manifold $M_1$ is directly fluidly coupled to a hydraulic pump and manifold $M_2$ is directly fluidly coupled to the pump reservoir. Pistons 166 retract when $M_1$ is directly fluidly coupled to the reservoir and $M_2$ is directly coupled to the pump. The flow can be reversed by adjusting a valve V so as to cause the pistons 166 to retract. Such an arrangement is well known in the art.

Support plate 160 and the cylinder arrangement 162 shown in FIGS. 22 and 23 can be used to replace the cylinder 103. Anchoring devices 100 and 100' can be used in lieu of anchoring device 50 to install the pier foundation 10.

In some applications, the structure to be supported by the foundation is subjected not only to compressive forces and tensile forces, but also bending moments. One such example is a billboard, which can have both torsional moment and bending moment applied thereto due to wind effects.

In that case, a mandrel type or bearing and moment foundation 170 may be used as shown in FIGS. 24–27. The mandrel type foundation 170 includes a rectangular shaped upper bearing plate 172 having a central hole and a tube 174, which is coaxial with the hole, attached to the bearing plate 172 and depending from an underside of the bearing plate 172. Angled side members 176 having side surfaces converge from an underside of the plate 172 to a circular distal end of the tube 174 and define a lower surface of the foundation and has a tip or cutting edge 178. Angled side members 176 define a wedge member. The distal end portion of the tube 174 forms part of tip 178. Tip 178 also includes straight portions extending 180 degrees apart extending from the circular portion of the tube 174. The base of the wedge member adjacent the bearing plate 172 is rectangular shaped. A horizontally extending lip portion 179 extends beyond the base section of side members 176. The foundation 170 may be made of plastic, wood, metal or concrete.

Figure 24:
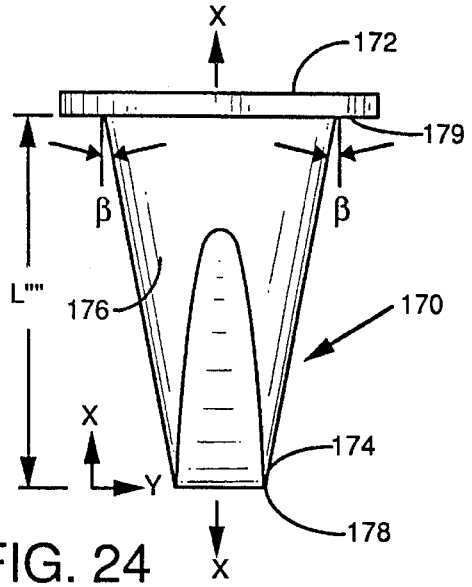
FIG. 24 is a side view of a mandrel type foundation that can be used with an anchoring device.
Figure 25:
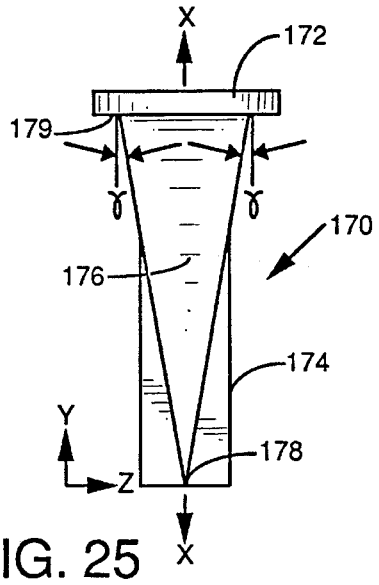
FIG. 25 is an end view of the mandrel type foundation shown in FIG. 24.
Figure 26:
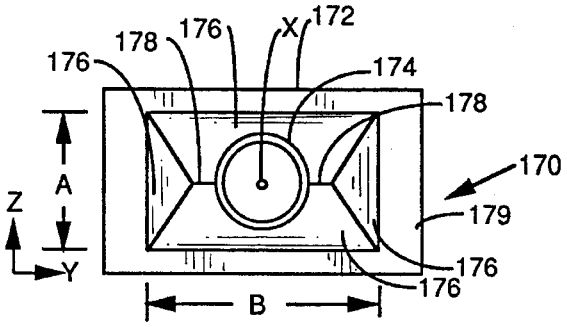
FIG. 26 is a bottom view of the mandrel type foundation shown in FIG. 24.
Figure 27:
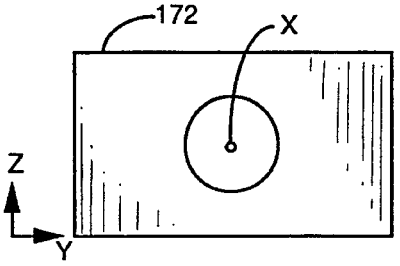
FIG. 27 is a top view of the mandrel type foundation shown in FIG. 24.

In operation, the bottom side plates 112 are set in the soil as previously discussed. The upper portion of the anchoring device, i.e., the cylinders and bearing plate 106, are removed and the rod 102 is passed through the tube 174. Preferably, the inner diameter of tube 174 is greater than tube 104. Tubes 104 and 174 are positioned so that they are coaxial with each other and tip 178 rests on the upper surface of soil 11. Bearing plate 106 and cylinders are then coupled to rod 102 so that the bearing plate 106 rests on an upper surface of bearing plate 172. Bearing plate 106 is now spaced apart from an upper portion of tube 104. Activation of the hydraulic cylinder pushes or forces the mandrel type foundation 170 into the soil. The converging side surfaces of the angled side members 176 contact, compact and consolidate the surrounding soils outwardly and downwardly in a predetermined manner and ratio. This is continued until the lip 179 contacts the soil 11 and further compacts and consolidates the soil. The lip 179 prevents slippage of the soil and aids in further compaction. As can be seen in FIGS. 24–26, the dimensions A and B of the side members 176 differ about the Y and Z axes. This affects the torsional strength of the foundation about the longitudinal X axis as well as the bending strength about the Y and Z axes. Further, the mandrel foundation 170 utilizes frictional forces between the side members 176 and the soil, and the outward and downward compaction and consolidation of a prestressed zone of the soil, which results in a strong foundation that can resist the above-described twisting and overturning or bending moment, plus provide load bearing strength.

The strength of the foundation to resist the bending moments about the Y and Z axes is a function of the angles $\beta$ and $\gamma$, respectively. $\beta$ and $\gamma$ are defined between the respective angled side members 176 and an axis parallel to the X axis. Further, the greater the surface area about the perimeter of side members 176, the greater the load bearing capacity of the foundation 170 due to the frictional forces. Preferably, $\beta$ and $\gamma$ should be greater than zero degrees. It is believed that the larger the value of angles β and γ, the more the foundation 170 will resist bearing. However, in some instances, one of the angles β and γ could be zero degrees while the other of the angles β and γ would be greater than zero degrees, so that only two oppositely positioned side members 176 converge toward each other and the other two oppositely positioned side members 176 are parallel to each other. Preferably, the lip 179 is contained in a plane normal to the X axis.

It is believed that the load bearing strength of the installed foundation 170 as well as the twisting and bending moments strength can be correlated to a reading on gauge G as the foundation is set in the soil. Hence, a foundation 170 can be custom designed (i.e., the angles β and γ can be determined as well as the dimensions A and B and the length L"" of the foundation 170) once the load bearing, bending moment and twisting moment characteristics of the structure to be supported are known.

Figure 28A:
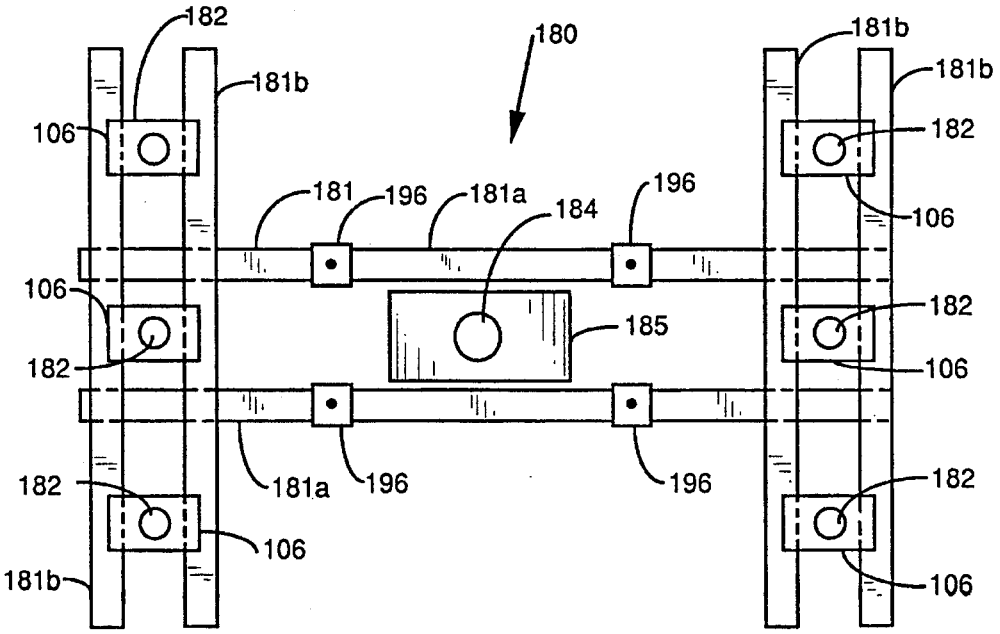
Figure 28B:
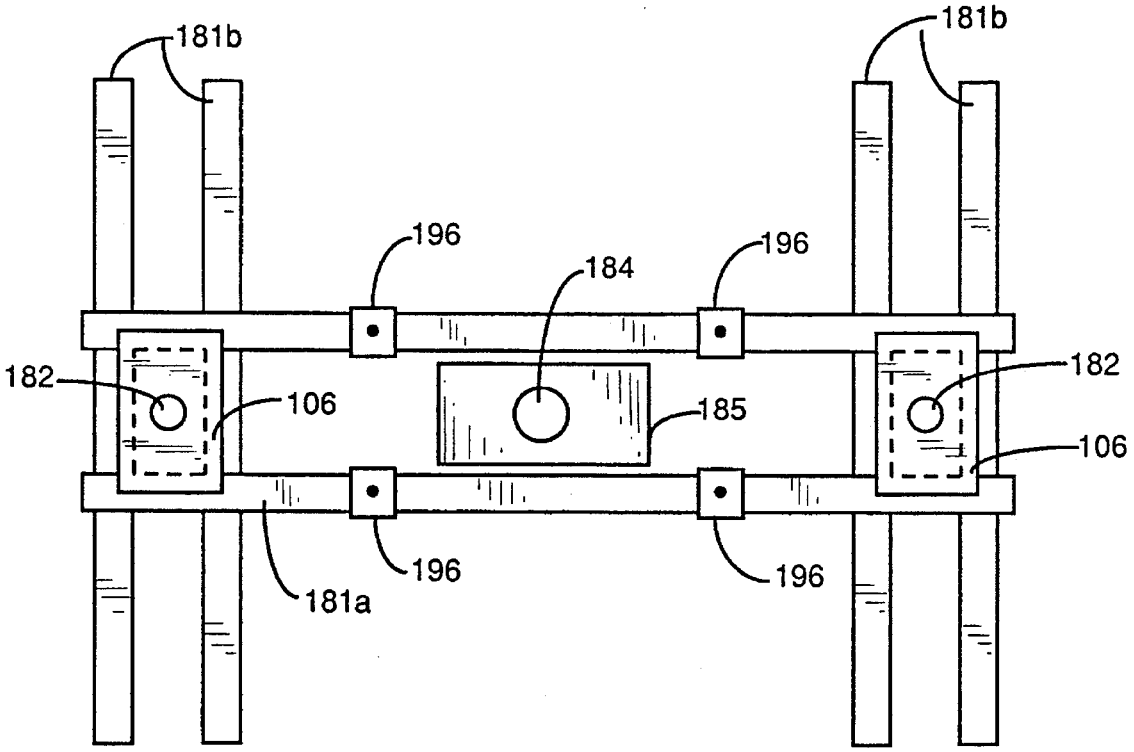

In some instances, one anchor may not be strong enough to set a foundation. A solution to this problem is the use of a grillage 180 as shown in FIGS. 28*a*–32. As shown in FIGS. 28*a* and 28*b*, the grillage 180 includes a plurality of structural members 181*a* and 181*b*, such as timbers or steel I-beams, that are criss-crossed. A plurality of auxiliary anchors 182 are installed to hold the two pairs of auxiliary structural members 181*b* in place. Any type of anchor can be used. Preferably, each auxiliary anchor 182 is coupled to a bearing plate 106, which is supported on the auxiliary structural members 181*b*.

Figure 28C:
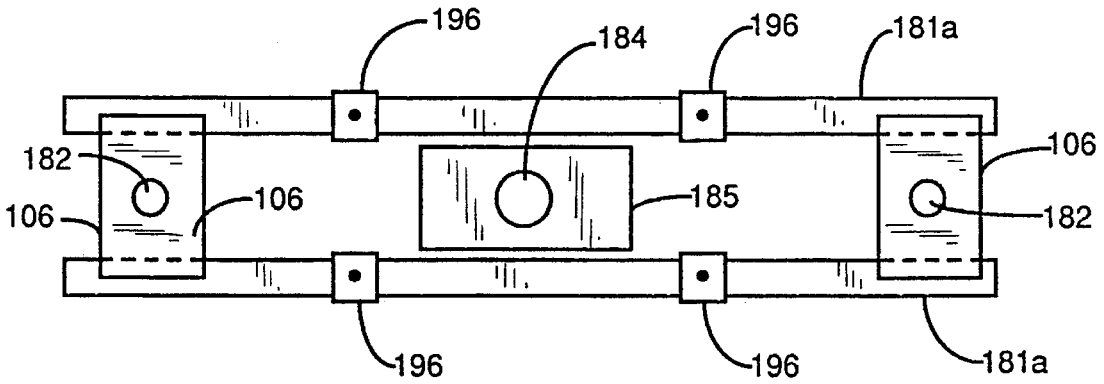

As shown in FIG. 28*a*, a center anchor 184 is then installed between a pair of intermediate structure members 181*a* utilizing an anchoring device, such as anchoring device 100 or 100' as previously discussed. The auxiliary structural members 181*b* rest on intermediate structural members 181a. As shown in FIG. 28*b*, the intermediate structural members 181*a* rest on the auxiliary structural members 181*b*. As shown in FIG. 28*c*, no auxiliary structural members 181*b* are present and the intermediate structural members 181*a* rest on the ground having anchors 182 and bearing plates 106 positioned at the ends thereof.

As shown in FIG. 29 of the drawings, a foundation 185 can be installed by placing the foundation 185 on the soil 11 between the pair of intermediate structural members 181 (of which only one is shown) of the grillage shown in FIG. 28*b*, placing the centering collar 148 on an upper surface of the foundation 185 so that the central collar tube rests on an upper surface of the foundation 185. Hydraulic cylinder 103 rests on an upper surface of the centering collar flange. A bearing plate 106 rests on top of the piston of hydraulic cylinder 103. Bearing plate 106 is spaced away from tube 104.

An anchor removal member 186 rests on an upper surface of bearing plate 106 and is secured to anchor 184. As shown in FIGS. 33 and 34, anchor removal member 186 includes a hollow tubular member 188 attached to an upper base plate 190 and a lower base plate 191. A plurality of fins 192 attach to base plates 190 and 191 and hollow tubular member 188. A plurality of holes are formed in the base plate 190 adapted to receive cables or threaded rods 194. Preferably, four rods 194 pass through the respective holes adjacent respective corners of plate 190 and are secured at distal ends to respective brackets 196 attached to grillage intermediate structural members 181 of the grillage 180 shown in FIG. 28*b*. Restraining nuts 198 are secured to ends of cables 194 and rest on plate 190. Central holes are provided in base plates 190 and 191, which are coaxial with the hollow tubular member 188, thereby defining a passageway.

Referring to FIG. 29, pressurizing the hydraulic cylinder 103 causes the hydraulic cylinder piston to extend bearing against bearing plate 106. The bearing plate 106 bears or is forced against the anchor removal member 186, which is held in place by the rods 194 connected to the grillage 180. Hence, the cylinder 103 forces the foundation 185 into the soil 11. The grillage 180 as shown in FIG. 28*b*, the centering column 148, the cylinder 103 and the anchor removal member 186 can be removed and a structure can be placed on the installed foundation 185. Alternatively, the grillage 180 can remain and be used to support a structure, such as a trailer home in combination with one of the foundations 185 and/or anchorages 182 and 184. The centering column 148 should be of sufficient length so that an upper portion of tube 104 does not contact the cylinder 103 during installation of the foundation 185. Further, as shown in FIG. 29, support vanes 200 can be secured to the outer surface of a tubular member 202 forming a friction type foundation 185.

FIG. 30 shows an arrangement for installing a friction type foundation 185, which is similar as shown in FIG. 29, except cylinder 103 is replaced by cylinder arrangements 162 and the tightening apparatus 140 is provided and positioned between anchor removal member 186 and support plate 160, and the grillage 180 is of the type shown in FIG. 28*c*. The centering column 148 should be of sufficient length so that an upper portion of tube 104 does not contact bearing plate 106 during setting of the foundation.

FIG. 31 shows an arrangement to test the strength of the foundation after it has been installed using the grillage 180 shown in FIG. 28*b*. Essentially, after a period of time has elapsed from when the foundation 185 has been installed, the restraining nut 105 is removed (the anchor 184 can also be removed). Cylinders 162 are pressurized to a predetermined pressure to cause the piston arms 166 to bear against the top of the foundation 185. If the foundation 185 does not move in the downwardly direction, then it is properly installed. Also, this arrangement can be used to test the strength of auxiliary anchors 182. In that case, a foundation need not be set in the soil. A bearing plate can be laid on top of the soil in lieu of the foundation in the arrangement shown in FIG. 31. Expansion of the pistons will cause a test pulling force applied to the auxiliary anchors 182 through the anchor removal member 186, rods 194 and structural members 181*a* and 181*b*. If the anchors do not move, then they have been properly installed.

Finally, as shown in FIG. 32, after the foundation 185 is set using the grillage shown in FIG. 28*a*, the hydraulic setting device 100 can be removed by loosening nut 132 using the nut tightening apparatus 140 so that the bottom side plates can be positioned into a retracted vertical position. A lifting truck T can then be connected to the fins 146. The anchoring device 184 is then raised through the bore hole 30 and the passageway of the anchor removal member 186 and centering collar 148.

It is important to note that any number of structural members 181*a* and 181*b* can be used to form a grillage as described, so that the grillage can be expanded along the soil surface to accommodate many different types of geometries and more than one foundation. Further, any of the grillages disclosed can be substituted for one another, can be used to install any of the foundations disclosed herein, and can be utilized on any of the anchors disclosed.

Having described the presently preferred embodiments of my invention, it is to be understood that it may otherwise be embodied within the scope of the appended claims.

I claim:

1. An anchoring and foundation apparatus adapted to be installed in an earthen hole comprising:

a vertical support, said support comprising a vertical rod secured within a pipe column;

a pivot plate secured to said pipe column;

a plurality of spaced media consolidation plates swingably mounted about respective pivot points on said pivot plate, each of said plates having a media facing surface having an upper edge and a lower edge, said upper edge positioned relatively closer to said vertical pivot plate than said lower edge;

a plurality of pins secured to said pivot plate, wherein each of said media consolidation plates includes a lug attached thereto and pivotally attached to said pivot plate through respective ones of said pivot pins, an upper end of each of said lugs is arcuate shaped and slidably received within a support member attached to said pivot plate, said support member having a support surface whereby said arcuate shaped end slidably contacts said support surface;

a rib disposed along said lower edge of respective ones of said media consolidation plates with said upper edge of said respective plates being free of ribs;

tapered side ribs disposed along sides of respective ones of said media consolidation plates;

a cone adapted to contact said upper edge and force the plates outwardly and upwardly when moved in an upwardly vertical direction, said cone having a tapered contacting surface;

force applying means for swinging said media consolidation plates outwardly and upwardly, wherein said force applying means comprises a hydraulic motor means and gauge means for measuring the hydraulic force being applied by the force applying means; and a bearing plate secured to said pipe column and adapted to rest on a soil surface, said vertical central rod includes threads and a threaded nut is threadably received on said vertical rod means adjacent one of said bearing plate and said pivot plate and said cone is secured to a lower end of said vertical rod adjacent said media consolidation plates, whereby said bearing plate is forced into the soil and in turn compacts and consolidates the soil between said bearing plate and said media consolidation plates when said media consolidation plates are forced outwardly and upwardly into the soil toward said bearing plate to compact and consolidate the soil adjacent thereto and whereby after said media consolidation plates are swung upwardly and outwardly, said nut is tightened against said one of said bearing plate and said pivot plate thereby locking said media consolidation plates in place.

2. An anchoring and foundation apparatus adapted to be installed in an earthen hole as claimed in claim 1 further comprising:

guiding and support members provided on said pipe column.

3. An anchoring and foundation apparatus adapted to be installed in an earthen hole as claimed in claim 2 wherein said guiding and support members are fins disposed about an exterior surface of said column.

4. An anchoring and foundation apparatus adapted to be installed in an earthen hole as claimed in claim 1, wherein said force applying means is a hollow core cylinder means.

* * * * *